US010633972B2

(12) United States Patent
Welte

(10) Patent No.: US 10,633,972 B2
(45) Date of Patent: Apr. 28, 2020

(54) VANE CELL PUMP WITH A SUB-VANE REGION TO WHICH PRESSURE CAN BE APPLIED

(71) Applicant: Schwäbische Hüttenwerke Automotive GmbH, Aalen-Wasseralfingen (DE)

(72) Inventor: Claus Welte, Aulendorf (DE)

(73) Assignee: Schwäbische Hüttenwerke Automobile GmbH, Aalen-Wasseralfingen (DE)

( * ) Notice: Subject to any disclaimer, the term of this patent is extended or adjusted under 35 U.S.C. 154(b) by 287 days.

(21) Appl. No.: 15/635,445

(22) Filed: Jun. 28, 2017

(65) Prior Publication Data

US 2018/0003176 A1 Jan. 4, 2018

(30) Foreign Application Priority Data

Jun. 30, 2016 (DE) ..... 10 2016 211 913

(51) Int. Cl.
*F01C 21/08* (2006.01)
*F01C 21/10* (2006.01)
(Continued)

(52) U.S. Cl.
CPC ..... *F01C 21/0863* (2013.01); *F01C 21/108* (2013.01); *F04C 2/3446* (2013.01); *F04C 15/06* (2013.01); *F04C 2210/206* (2013.01)

(58) Field of Classification Search
CPC .... F01C 21/0863; F01C 21/108; F04C 15/06; F04C 2/3446
See application file for complete search history.

(56) References Cited

U.S. PATENT DOCUMENTS 6,267,566 B1 7/2001 Konishi et al.
9,903,366 B2 2/2018 Kido
(Continued)

FOREIGN PATENT DOCUMENTS

CN 101163883 A 4/2008
CN 104912791 A 9/2015
(Continued)

OTHER PUBLICATIONS

Machine Translation of WO-2015086216, Inventor: Reichenmiller, Title: Rotary Vane Pump With Damping Volume, Published on Jun. 18, 2015. (Year: 2015).*
(Continued)

*Primary Examiner* — Mary Davis
(74) *Attorney, Agent, or Firm* — RatnerPrestia

(57) ABSTRACT

A vane cell pump, includes a rotatable rotor having vanes which can be moved back and forth; an end plate with a pressure passage for discharging pressure fluid and a supply passage for supplying a sub-vane region with pressure fluid; a flow channelling device on an end face of the end plate facing axially away from the rotor; a first outlet region for discharging a first partial flow of the pressure fluid; a second outlet region for discharging a second partial flow of the pressure fluid; a first flow path along which the first partial flow flows through the first outlet region; a second flow path connecting the pressure passage to the supply passage, diverges from the first flow path and is delineated by the flow channelling device; and a third flow path connecting the supply passage to the second outlet region and delineated by the flow channelling device.

16 Claims, 16 Drawing Sheets

(51) Int. Cl.
*F04C 2/344* (2006.01)
*F04C 15/06* (2006.01)

(56) References Cited

U.S. PATENT DOCUMENTS

| | | | |
|---|---|---|---|
| 2005/0047938 | A1 | 3/2005 | Konishi et al. |
| 2008/0075615 | A1 | 3/2008 | Staton et al. |
| 2014/0234150 | A1 | 8/2014 | Sugihara et al. |
| 2014/0301877 | A1 | 10/2014 | Bohm |
| 2016/0305427 | A1 | 10/2016 | Welte |

FOREIGN PATENT DOCUMENTS

| | | | |
|---|---|---|---|
| DE | 19631846 | A1 | 2/1997 |
| DE | 19927792 | A1 | 3/2000 |
| DE | 102013113894 | A1 | 6/2015 |
| DE | 102015105928 | A1 | 10/2016 |
| JP | 2009264160 | A | 11/2009 |
| WO | 2013064386 | A2 | 5/2013 |
| WO | 2015086216 | A1 | 6/2015 |

OTHER PUBLICATIONS

Chinese Office Action issued in Chinese Application No. 201710522975.4, dated Oct. 9, 2018, 16 pages (with English translation).
Extended European Search Report for European Application No. 17177916.8, dated Oct. 5, 2017, including partial English translation, 8 pages.

* cited by examiner

VANE CELL PUMP WITH A SUB-VANE REGION TO WHICH PRESSURE CAN BE APPLIED

CROSS REFERENCE TO RELATED APPLICATIONS

This application claims benefit of priority to German Patent Application No. 10 2016 211 913.3, filed Jun. 30, 2016, the contents of such application being incorporated by reference herein.

FIELD OF THE INVENTION

The invention relates to a vane cell pump comprising at least one vane and an assigned sub-vane region into which a pressure fluid to be delivered by the pump can be introduced in order to apply pressure to the vane.

BACKGROUND OF THE INVENTION

In vane cell pumps of the type cited, the pressure fluid delivered by the pump is applied to (each of) the one or more vanes in the sub-vane region, in order to ensure that even in the lower rotational speed range, such as for example when the pump is started up, the vane(s) is/are pressed outwards towards a cam structure surrounding the rotor, in order to fluidically separate the delivery cells of the pump from each other. Supplying the sub-vane region is associated with a reduction in the effectiveness of the pump.

SUMMARY OF THE INVENTION

An aspect of the invention aims to reliably supply a sub-vane region of a vane cell pump with pressure fluid even at low rotational speeds of the pump and to minimise the associated loss of effectiveness.

An aspect of the invention is a vane cell pump, comprising: a rotor which can be rotated about a rotational axis; and one or more vanes which can (each) be moved back and forth in an assigned, preferably slot-shaped vane receptacle of the rotor. The singular quantifier "a(n)" or "one" is used as a numeral only in the phrase "one or more" and otherwise always as the indefinite article "a(n)". A cam structure surrounds the rotor and delineates a delivery space of the pump on the radially outer side. The rotor delineates the delivery space on the radially inner side. When the rotor is rotationally moved, the cam structure guides the vane(s) such that delivery cells which periodically increase and decrease again in size are formed in the course of the rotational movement. To this end, an inner side of the cam structure which radially faces the rotor comprises a guiding cam against which the sole vane presses or, preferably, the multiple vanes press such that a sealing gap is formed between the cam structure and the respective vane, wherein said sealing gap fluidically separates from each other the adjacent delivery cells adjoining the respective vane. The cam structure can be magnetic in order to draw the vane(s) outwards.

The vane cell pump also comprises an end plate axially facing the rotor and comprising: a pressure passage for discharging pressure fluid from the pump; and a supply passage for supplying a sub-vane region with pressure fluid diverted from the pressure fluid flowing through the pressure passage. If the vane cell pump comprises multiple vanes which can be moved back and forth in vane receptacles of the rotor, then a sub-vane region is formed in each of the vane receptacles, wherein said sub-vane region is supplied with the pressure fluid via the supply passage(s) of the end plate while the pump is in operation.

The end plate delineates the delivery space on an end face of the rotor. A housing part delineates the delivery space on the other end face of the rotor. The end plate can be fixedly joined together from multiple separately produced pieces, but is preferably moulded as a whole in one piece in an original-moulding method. The term "end plate" should not be understood to mean that the end plate has to be a plate in the narrowest sense. It can conversely comprise a planar end surface which faces the rotor and delineates the delivery space on the relevant end face of the rotor. The end plate can comprise one or more pressure passages and/or one or more supply passages.

The pump can be formed as a mono-flux or multi-flux pump. Even if it is embodied as a mono-flux pump, it can comprise multiple pressure passages on the high-pressure side, which in expedient embodiments are provided in the end plate. If the pump is formed as a multi-flux pump, the end plate expediently comprises at least one pressure passage for each flux. Irrespective of whether the pump is embodied as a mono-flux or multi-flux pump, the end plate can comprise one or more supply passages. It preferably comprises at least one supply passage for each flux. If multiple supply passages are provided, each of the supply passages can be provided in the end plate. Wherever features of the pressure passage are described, these features are preferably likewise exhibited by each additional pressure passage where multiple pressure passages are provided. Wherever features of the supply passage are described, these features are preferably likewise exhibited by each additional supply passage where multiple supply passages are provided.

The pressure fluid flowing through the pressure passage is discharged through a first outlet region and a second outlet region of the pump along different flow paths by means of a flow channelling device on an end face of the end plate facing axially away from the rotor. The first outlet region serves to discharge a first partial flow of the pressure fluid flowing through the pressure passage. The second outlet region serves to discharge a second partial flow of the pressure fluid flowing through the pressure passage. In advantageous embodiments, the first outlet region and/or the second outlet region can (each) be formed as one or more passage openings of the flow channelling device.

The flow channelling device can be part of the end plate. It can be fixedly joined, for example fused, adhered or screwed, to the end plate. It can also be moulded jointly with the end plate in an original-moulding method. In preferred embodiments, however, the flow channelling device is produced separately from the end plate and fitted, preferably detachably, when the pump is assembled. When fitted, it is preferably in direct contact with the end plate. It is preferably in axial pressure contact with the end plate when fitted.

In accordance with an aspect of the invention, a flow channelling region formed on the high-pressure side of the pump by means of the end plate and the flow channelling device is configured such that a first flow path, a second flow path and at least one other, third flow path are formed for the pressure fluid flowing out of the pressure passage of the end plate. The first partial flow of the pressure fluid flows off through the first outlet region along the first flow path. The second flow path diverges from the first flow path and connects the pressure passage to the supply passage of the end plate. The flow channelling device delineates the second flow path, preferably at least in the axial direction, such that the diverted pressure fluid flows to the supply passage along the second flow path between the flow channelling device and the facing end face of the end plate. The third flow path connects the supply passage to the second outlet region, such that pressure fluid can flow off from the supply passage to and through the second outlet region. The third flow path is likewise delineated by the flow channelling device, preferably at least in the axial direction, such that pressure fluid flows to the second outlet region along the third flow path between the flow channelling device and the facing end face of the end plate.

Because the first partial flow flows off along the first flow path, and a portion of the pressure fluid flowing through the pressure passage of the end plate is redirected into the second flow path by means of the flow channelling device, it is possible to ensure a supply to the sub-vane region via the second flow path and, conversely, discharge the first partial flow directly, along the first flow path, over a short distance and therefore with only a low flow resistance and little loss.

It is advantageous if the first outlet region overlaps with a downstream outlet opening of the pressure passage as viewed axially, so that the first partial flow can flow from the downstream outlet opening of the pressure passage to the first outlet region over a short distance in the axial direction and preferably also flow off from the pump axially through the first outlet region. In preferred embodiments, the first outlet region only overlaps a first partial region of the downstream outlet opening of the pressure passage as viewed axially, and the flow channelling device overlaps a second partial region of the downstream outlet opening of the pressure passage, such that only a portion of the pressure fluid flowing through the pressure passage flows off through the first outlet region as the first partial flow, and another portion of the pressure fluid flowing through the pressure passage is channelled to the side, into the second flow path, by the flow channelling device. The flow channelling device can act as a baffle for the portion of the pressure fluid flowing through the pressure passage which is to be deflected, wherein said baffle deflects the relevant portion of the flow. By dividing the flow into the first partial flow, which flows off through the first outlet region, and the other partial flow which is deflected into the second flow path, the first partial flow is discharged over a short distance axially and therefore with little loss and, conversely, a flow towards the supply passage and therefore a reliable supply to the sub-vane region is enforced.

In order to ensure that the sub-vane region is supplied with pressure fluid, it is preferred if the flow resistance of the third flow path, which leads from the supply passage to the second outlet region, is greater than the flow resistance of the second flow path along which the diverted pressure fluid flows from the point of diversion up to the supply passage. In another embodiment, which likewise serves to ensure that the sub-vane region is supplied with pressure fluid, the flow resistance of the first flow path can be greater than the flow resistance of the second flow path. Although it is already advantageous if only one of these two measures is implemented, a supply is particularly reliably ensured if the second flow path exhibits a lower flow resistance than the first flow path and also a lower flow resistance than the third flow path. Where the flow resistance of a flow path is mentioned, this refers to the total resistance of the respective flow path, i.e. the resistance which the pressure fluid experiences in total as it flows through the respective flow path.

A resistance structure can be arranged in the first flow path in order to increase the flow resistance of the first flow path. A resistance structure can be arranged in the third flow path in order to increase the flow resistance of the third flow path. In preferred embodiments, a resistance structure is arranged in both the first flow path and the third flow path in order to increase the flow resistance of both the first flow path and the third flow path. The increase in the flow resistance of the two flow paths can be achieved by arranging resistance structures which are separate from each other, i.e. one resistance structure for the first flow path and another resistance structure for the third flow path. When increasing the resistance of the two paths, the resistance structure in the first flow path and the resistance structure in the third flow path are however more preferably formed by the same resistance structure.

The resistance structure, or as applicable the multiple resistance structures, (each) form/s part of the flow channelling device. The flow channelling device can consist of a flow channelling structure which is produced as a design unit and which also simultaneously forms the one or more resistance structures. The flow channelling device can however also consist of multiple parts, as is preferred, and comprise a flow channelling structure and one or more resistance structure(s) produced separately from it. The flow channelling device can in particular consist of two parts, namely a flow channelling structure and a resistance structure. In equally preferred embodiments, the flow channelling device comprises a flow channelling structure, a resistance structure and an abutment structure, wherein it can in particular consist of these three structures in such embodiments. The resistance structure and the abutment structure can advantageously form one or more valves in the first flow path and/or one or more valves in the second flow path, each in the form of a Reed valve.

The resistance structure can in particular be an axially thin, planar structure. The resistance structure can for example be a sheet-metal structure or sheet-like structure, wherein the word "sheet" is primarily intended to describe only the shape of the resistance structure and not restrict it in terms of its material. Preferred materials do however include metals and metal alloys, in particular steels. A thin, planar resistance structure is easy to fit and can be easily and flexibly configured with regard to the flow conditions to be achieved. The resistance structure is preferably arranged axially between the end plate and the flow channelling structure. One or more other structure(s), each of which is preferably thin over an area, can be arranged axially between the end plate and the resistance structure. One or more structure(s), each of which is preferably thin over an area—for example, the abutment structure mentioned—can be arranged between the resistance structure and the flow channelling structure. The end plate, the resistance structure, the flow channelling structure and one or more other optional structures are preferably arranged one lying on the other in a layered manner. Preferably, the resistance structure directly adjoins the end plate axially.

If the flow channelling device is produced separately from the end plate and connected, preferably fitted, to it, then the flow channelling device can consist of one part in simple embodiments or can consist of multiple parts, in particular two parts, in alternative embodiments. In embodiments in which it consists of one part, the flow channelling device consists of a flow channelling structure; in embodiments in which it consists of multiple parts, it comprises a flow channelling structure. The flow channelling structure delineates at least some of the first outlet region and/or some of the second outlet region.

In preferred embodiments, the flow channelling structure comprises one or more mutually separate passages which forms or which jointly form the first outlet region. Instead or as well, the flow channelling structure can comprise one or more mutually separate passages which forms or which jointly form the second outlet region. The respective passage can lie completely within the flow channelling structure, i.e. can be encircled by it on all sides. The flow channelling structure need not however comprise a structural region separating the outlet regions from each other. The first outlet region and the second outlet region can adjoin each other directly. In such embodiments, it is advantageous if the flow channelling structure forms the first and second outlet region as an outlet which is a joint outlet but is encircled on all sides by the flow channelling structure. If the first and second outlet region adjoin each other directly, the flow is guided in accordance with the invention in the flow channelling region by appropriately arranging the first outlet region and the second outlet region relative to the outlet opening of the pressure passage. The first outlet region and the second outlet region can in particular be arranged relative to the outlet opening of the pressure passage such that the first flow path is shorter than the sum of the lengths of the second flow path and the third flow path. The first flow path is preferably also shorter than the third flow path and/or the second flow path, wherein the flow paths are each considered in their own right with regard to this relationship. If the first outlet region and the second outlet region adjoin each other directly, an annular strip-shaped passage of the flow channelling structure can advantageously form this joint outlet. The first outlet region and the second outlet region can be arranged directly next to each other in the circumferential direction of the annular strip-shaped passage.

The vane cell pump can in particular be installed in vehicles, preferably motor vehicles, or can be provided for being installed in this way. The pump is preferably used as a hydraulic pump; in such applications, the pressure fluid is a liquid. The pump can for example be used as a lubricating oil pump for supplying an internal combustion engine or other assembly of a motor vehicle with lubricating oil and/or cooling oil. The pump can also serve as a working pump for supplying an assembly with a working fluid, preferably a working liquid such as for example hydraulic oil. Using it as a gear pump for supplying a transmission, in particular an automatic transmission of a vehicle, with transmission oil is thus also a preferred application. In principle, however, the pump can also be advantageously used outside of automotive engineering, for example in order to supply a stationary combustion engine. It can also be used to supply a combustion engine on board a watercraft or aircraft with lubricating oil or a working medium. Another particularly preferred application is that of a gear pump for supplying a transmission in a wind turbine or a transmission in a facility for generating energy.

The vane cell pump can be embodied as a so-called cartridge pump. When embodied as a cartridge pump, the vane cell pump in accordance with the invention can be inserted, as a fitted design unit, completely into a cup-shaped installation space and fixed within the installation space. Such solutions are for example known in gear pumps which are inserted in the axial direction into an installation space of the pump of a transmission and secured in an installed position, for example by means of a locking connection. A cartridge pump of this type is known for example from DE 10 2015 105 928 A1, which is incorporated by reference. The vane cell pump in accordance with an aspect of the invention can correspond to this known cartridge pump in terms of the features relevant to installing it in the installation space of the pump. Conversely, the vane cell pump in accordance with the invention differs from the known pump in terms of the flow channelling region configured by means of the flow channelling device and in terms of the flow guiding features relating to this.

Features of the invention are also described in the aspects formulated below. The aspects are worded in the manner of claims and can be substituted for them. Features disclosed in the aspects can also supplement and/or qualify the claims, indicate alternatives to individual features and/or broaden claim features. Bracketed reference signs refer to example embodiments of the invention which are illustrated below in figures. They do not restrict the features described in the aspects to their literal sense as such, but do conversely indicate preferred ways of implementing the respective feature.

Aspect 1. A vane cell pump, comprising:

1.1 a rotor (10) which can be rotated about a rotational axis (R), and one or more vanes (11) which can (each) be moved back and forth in a respective vane receptacle of the rotor (10);

1.2 a cam structure (5) which surrounds the rotor (10) and, when the rotor (10) is rotationally moved, guides the vane(s) (11) such that delivery cells (6) which periodically increase and decrease again in size are formed;

1.3 an end plate (4) axially facing the rotor (10) and comprising a pressure passage (14) for discharging pressure fluid and a supply passage (15) for supplying a sub-vane region (12) with pressure fluid;

1.4 a flow channelling device (20; 20, 30; 20, 30, 40) on an end face of the end plate (4) facing axially away from the rotor (10); and 1.5 a first outlet region (24) for discharging at least a first partial flow (S1) of the pressure fluid flowing through the pressure passage (14).

Aspect 2. The vane cell pump according to the preceding aspect, wherein the flow channelling device (20; 20, 30; 20, 30, 40) axially delineates a flow channelling region which is situated downstream of the pressure passage (14) and connected to the supply passage (15).

Aspect 3. The vane cell pump according to any one of the preceding aspects, wherein the second flow path (P2) diverges from the first flow path (P1).

Aspect 4. The vane cell pump according to any one of the preceding aspects, wherein the flow channelling device (20; 20, 30; 20, 30, 40) forms at least some of a circumferential edge which surrounds the first outlet region (24).

Aspect 5. The vane cell pump according to any one of the preceding aspects, comprising:

5.1 a first flow path (P1) along which the first partial flow (S1) flows through the first outlet region (24); and 5.2 a second flow path (P2) which connects the pressure passage (14) to the supply passage (15) and is delineated by the flow channelling device (20; 20, 30; 20, 30, 40).

Aspect 6. The vane cell pump according to any one of the preceding aspects, comprising: a second outlet region (26) for discharging a second partial flow (S2) of the pressure fluid flowing through the pressure passage (14).

Aspect 7. The vane cell pump according to any one of the immediately preceding two aspects, wherein the first flow path (P1) extends at least substantially in the axial direction in relation to the rotational axis (R).

Aspect 8. The vane cell pump according to any one of the immediately preceding three aspects, wherein the second flow path (P2) and/or the third flow path (P3) of Aspect 12 extend(s) at least substantially transverse to the rotational axis (R).

Aspect 9. The vane cell pump according to any one of the immediately preceding four aspects, wherein the first outlet region (24) overlaps a first partial region of a downstream outlet opening of the pressure passage (14) as viewed axially, and the flow channelling device (20; 20, 30; 20, 30, 40) overlaps a second partial region of the downstream outlet opening as viewed axially, such that a portion of the pressure fluid flowing out of the pressure passage (14) flows off through the first outlet region (24) as the first partial flow (S1) and another portion of the pressure fluid flowing out of the pressure passage (14) is channelled to the side, into the second flow path (P2), by the flow channelling device (20; 20, 30; 20, 30, 40).

Aspect 10. The vane cell pump according to the preceding aspect, wherein the flow channelling device (20; 20, 30; 20, 30, 40) comprises a deflecting region (25) which is near to and preferably extends up to and onto the first outlet region (24), and wherein the deflecting region (25) overlaps a partial region of the outlet opening of the pressure passage (14) as viewed axially, such that pressure fluid flowing out of the pressure passage (14) flows onto the deflecting region (25) and is thus deflected transverse to the rotational axis (R), towards the supply passage (15).

Aspect 11. The vane cell pump according to any one of Aspects 5 to 10, wherein the flow resistance of the first flow path (P1) is greater than the flow resistance of the second flow path (P2).

Aspect 12. The vane cell pump according to any one of Aspects 5 to 11, comprising a third flow path (P3) which connects the supply passage (15) to the second outlet region (26) and is delineated by the flow channelling device (20; 20, 30; 20, 30, 40).

Aspect 13. The vane cell pump according to the preceding aspect, wherein the flow resistance of the third flow path (P3) is greater than the flow resistance of the second flow path (P2).

Aspect 14. The vane cell pump according to any one of the immediately preceding two aspects, wherein the flow resistance of the third flow path (P3) is greater than the flow resistance of the first flow path (P1).

Aspect 15. The vane cell pump according to any one of the immediately preceding three aspects, wherein a resistance structure (30) is arranged in the third flow path (P3) in order to increase the flow resistance of the third flow path (P3).

Aspect 16. The vane cell pump according to any one of the preceding aspects, wherein a resistance structure (30) is arranged in a first flow path (P1) which leads from the pressure passage (14) to and through the first outlet region (24), in order to increase the flow resistance of the first flow path (P1).

Aspect 17. The vane cell pump according to any one of the preceding aspects, wherein the flow channelling device (20, 30; 20, 30, 40) comprises a flow channelling structure (20) for forming the first outlet region (24) and/or the second outlet region (26) according to Aspect 6 and a resistance structure (30) for increasing the flow resistance of a first flow path (P1), which leads from the pressure passage (14) to and through the first outlet region (24), and/or the flow resistance of the third flow path (P3) according to Aspect 12, wherein the resistance structure (30) is preferably arranged axially between the end plate (4) and the flow channelling structure (20).

Aspect 18. The vane cell pump according to any one of the immediately preceding three aspects, wherein the resistance structure (30) is a planar structure, preferably a disc, and is arranged axially between the end plate (4) and the flow channelling structure (20).

Aspect 19. The vane cell pump according to any one of the immediately preceding four aspects, wherein a shutter comprising one or more mutually spaced passages (31), preferably one or more passage holes, forms at least a partial region of the resistance structure (30) which is situated in the first flow path (P1) according to Aspect 5 and/or in the third flow path (P3) according to Aspect 12.

Aspect 20. The vane cell pump according to the preceding aspect, wherein the passages (31) are oval, circular, slot-shaped (straight or curved) or cruciform in cross-section.

Aspect 21. The vane cell pump according to any one of the immediately preceding two aspects, wherein the passages (31) are cylindrical or conical or trumpet-shaped or bell-shaped in the axial direction.

Aspect 22. The vane cell pump according to any one of the preceding aspects, wherein a sieve, fabric or other mesh forms at least a partial region of the resistance structure (30) which is situated in the first flow path (P1) of Aspect 5 and/or in the third flow path (P3) according to Aspect 12.

Aspect 23. The vane cell pump according to any one of Aspects 15 to 22, wherein the resistance structure (30) comprises one or more moving valve elements (33; 36; 38) which is/are arranged in the first flow path (P1) in order to vary a flow cross-section of the first flow path (P1), and/or one or more moving valve elements (34; 37; 39) which is/are arranged in the third flow path (P3) according to Aspect 12 in order to vary a flow cross-section of the third flow path (P3).

Aspect 24. The vane cell pump according to the preceding aspect, wherein the respective valve element (33; 33, 34; 36, 37; 38, 39) can be moved (into an aperture position) by the pressure fluid against an elastic restoring force in the direction of increasing the flow cross-section.

Aspect 25. The vane cell pump according to the preceding aspect, wherein the respective valve element (33; 33, 34; 36, 37; 38, 39) consists of a metallic material, preferably a spring-elastic metallic material, or an elastomeric material.

Aspect 26. The vane cell pump according to any one of the immediately preceding three aspects, wherein the respective valve element (33; 33, 34; 36, 37; 38, 39) is formed as a flexible spring tongue.

Aspect 27. The vane cell pump according to the preceding aspect, wherein the respective valve element (33; 33, 34; 36, 37; 38, 39) protrudes, preferably freely, from a root region in the circumferential direction or in the radial direction.

Aspect 28. The vane cell pump according to any one of the immediately preceding five aspects, wherein the flow channelling device (20, 30, 40) comprises an abutment (41, 42) for (each of) the valve element(s) (33, 34), said abutment (s) facing a rear side of the respective valve element in relation to the flow direction of the pressure fluid which is flowing off.

Aspect 29. The vane cell pump according to any one of the immediately preceding six aspects, wherein multiple valve elements (33; 36; 38) in the first flow path (P1) of Aspect 5 are arranged next to each other in parallel in relation to the flow of the pressure fluid and/or multiple valve elements (34; 37; 39) in the third flow path (P3) of Aspect 12 are arranged next to each other in parallel in relation to the flow of the pressure fluid.

Aspect 30. The vane cell pump according to any one of Aspects 15 to 29, wherein the resistance structure (30) is an axially thin, planar or sheet-like structure which comprises one or more passages (31) in at least one or more structural partial regions and/or one or more flexible tongues (33, 34; 36, 37; 38, 39) which decrease(s) a flow cross-section in the first flow path (P1) and/or a flow cross-section in the third flow path (P3) according to Aspect 12 and thus increase(s) the flow resistance of the respective flow path (P1, P3).

Aspect 31. The vane cell pump according to the preceding aspect, wherein the respective passage (31) and/or the respective flexible tongue is a die-cut passage or die-cut flexible tongue (33, 34).

Aspect 32. The vane cell pump according to any one of the preceding aspects, wherein the flow channelling device (20) comprises one or more valves (33, 41; 36; 38) in the first flow path (P1) of Aspect 5 in order to increase the flow resistance of the first flow path (P1) and/or one or more valves (34, 42; 37; 39) in the third flow path (P3) of Aspect 12 in order to increase the flow resistance of the third flow path (P3).

Aspect 33. The vane cell pump according to the preceding aspect, wherein multiple valves (33, 41; 36; 38) in the first flow path (P1) are arranged next to each other in parallel in relation to the flow of the pressure fluid and/or multiple valves (34, 42; 37; 39) in the third flow path (P3) are arranged next to each other in parallel in relation to the flow of the pressure fluid.

Aspect 34. The vane cell pump according to any one of the immediately preceding two aspects, wherein the respective valve (33, 41, 34, 42) is a Reed valve.

Aspect 35. The vane cell pump according to any one of the immediately preceding three aspects, wherein the respective valve (36, 37; 38, 39) is an elastomeric valve comprising a tongue-shaped, elastically flexible valve element (36, 37; 38, 39) made of an elastomer.

Aspect 36. The vane cell pump according to any one of the preceding aspects, wherein the flow channelling device (20; 20, 30; 20, 30, 40) comprises a flow channelling structure (20) or consists of a flow channelling structure (20), and the flow channelling structure (20) can be elastically deformed, preferably in a dimensionally elastic way, in order to exert a tensing force on the end plate (4) in the direction of the cam structure (5).

Aspect 37. The vane cell pump according to any one of the preceding aspects, wherein the flow channelling device (20; 20, 30; 20, 30, 40) comprises a flow channelling structure (20) or consists of a flow channelling structure (20), and the flow channelling structure (20) is formed as a disc spring.

Aspect 38. The vane cell pump according to any one of the preceding aspects, wherein the flow channelling device (20; 20, 30; 20, 30, 40) comprises a flow channelling structure (20) or consists of a flow channelling structure (20), and the flow channelling structure (20) at least partially surrounds the first outlet region (24) and/or the second outlet region (26) according to Aspect 6.

Aspect 39. The vane cell pump according to any one of the preceding aspects, wherein the flow channelling device (20; 20, 30; 20, 30, 40) comprises a flow channelling structure (20) or consists of a flow channelling structure (20), and a passage—preferably, an axial passage—extending through the flow channelling structure (20) forms the first outlet region (24) and/or the second outlet region (26) according to Aspect 6.

Aspect 40. The vane cell pump according to any one of the preceding aspects, wherein the flow channelling device (20; 20, 30; 20, 30, 40) comprises a flow channelling structure (20) or consists of a flow channelling structure (20), and the flow channelling structure (20) comprises a passage which extends in the shape of an annular strip around the rotational axis (R), and the passage forms the first outlet region (24) and the second outlet region (26) according to Aspect 6, such that the outlet regions (24, 26) are arranged next to each other in the circumferential direction.

Aspect 41. The vane cell pump according to the preceding aspect, wherein the outlet regions (24, 26) are arranged such that they directly adjoin each other in the circumferential direction or are arranged next to each other such that they are spaced from each other.

Aspect 42. The vane cell pump according to any one of the preceding aspects, wherein the flow channelling device (20; 20, 30; 20, 30, 40) comprises a flow channelling structure (20) or consists of a flow channelling structure (20), and wherein the flow channelling structure (20) comprises:

an inner channelling region (21) for channelling the pressure fluid flowing out of the pressure passage (14);

a positioning region (22), which surrounds the channelling region (21), for positioning the flow channelling structure (20) relative to the end plate (4);

an annular passage which separates the channelling region (21) from the positioning region (22); and at least two connecting structures (23) which are distributed over the circumference and connect the channelling region (21) spring-elastically to the positioning region (22) across the passage, wherein proceeding from a state in which the flow channelling structure (20) is not exposed to a load, the channelling region (21) can be axially spring-deflected towards the positioning region (22).

Aspect 43. The vane cell pump according to any one of the preceding aspects, wherein a positioning element (17) of the vane cell pump protrudes axially beyond the end plate (4);

the flow channelling device (20; 20, 30; 20, 30, 40) comprises a positioning counter element (27); and the flow channelling device (20; 20, 30; 20, 30, 40) is fixed in a predetermined position relative to the end plate (4) in a positioning engagement between the positioning element (17) and the positioning counter element (27).

Aspect 44. The vane cell pump according to the preceding aspect, wherein the positioning counter element (27) is a radial recess in an axial plan view and is attached to a passant (28), extending in the circumferential direction, for the positioning element (17).

Aspect 45. The vane cell pump according to any one of the preceding aspects, wherein the end plate (4) and the flow channelling device (20; 20, 30; 20, 30, 40) delineate the second flow path (P2) according to Aspect 5 and/or the third flow path (P3) according to Aspect 12 axially on both sides.

Aspect 46. The vane cell pump according to any one of the preceding aspects, wherein the flow channelling device (20; 20, 30; 20, 30, 40) partially overlaps an end face of the end plate (4) facing axially away from the rotor (10).

Aspect 47. The vane cell pump according to any one of the preceding aspects, wherein the vane cell pump is embodied as a cartridge pump and inserted into a cup-shaped installation space of the pump, which is preferably formed by an assembly which is to be supplied with the pressure fluid by the vane cell pump, or is provided for being inserted into a cup-shaped installation space of the pump.

Aspect 48. The vane cell pump according to the preceding aspect, wherein:

the flow channelling device (20; 20, 30; 20, 30, 40) comprises a flow channelling structure (20) or consists of a flow channelling structure (20);

the flow channelling structure (20) can be axially spring-deflected; and the vane cell pump is or can be axially clamped in the installation space of the pump by a spring force by means of the flow channelling structure (20).

Aspect 49. The vane cell pump according to any one of the immediately preceding two aspects, wherein a side of the vane cell pump which axially faces away from the flow channelling device (20; 20, 30; 20, 30, 40) comprises a securing region (19) or a securing element for establishing a locking engagement which axially secures the pump in the installation space.

Aspect 50. The vane cell pump according to any one of the preceding aspects, wherein in a peripheral structural region, the flow channelling device (20; 20, 30; 20, 30, 40) forms at least some of a circumferential edge which surrounds the first outlet region (24) and, in a central structural region, comprises an axial passage which can form an additional outlet region for the pressure fluid flowing out of the pressure passage (14).

Aspect 51. The vane cell pump according to any one of the preceding aspects, wherein the vane cell pump is used as a gear pump for supplying a transmission, such as for example an automatic transmission of a vehicle or a transmission of a wind turbine or other mechanical transmission, with lubricating and/or working fluid or as a lubricating oil pump for supplying a combustion engine, such as for example a drive motor of a vehicle or a combustion engine for generating power, with lubricating oil.

BRIEF DESCRIPTION OF THE DRAWINGS

The invention is described below on the basis of example embodiments. Features disclosed by the example embodiments, each individually and in any combination of features which are not mutually exclusive, advantageously develop the subject-matter of the claims, the subject-matter of the aspects above and also the embodiments described above. There is shown:

DETAILED DESCRIPTION OF THE INVENTION

Figure 1:
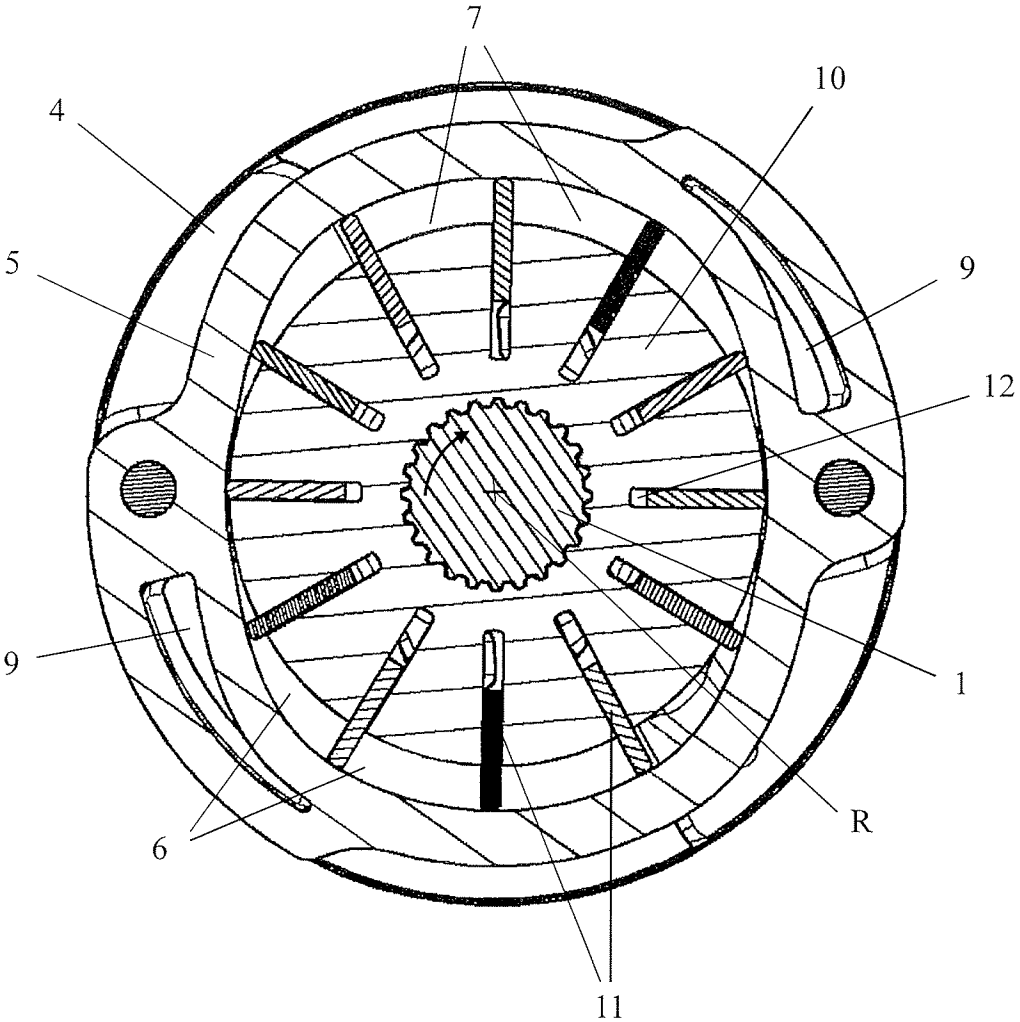
FIG. 1 a vane cell pump in a cross-section.

FIG. 1 shows a vane cell pump in a cross-section. The vane cell pump comprises a housing featuring a delivery space in which a rotor 10 is arranged such that it can be rotated about a rotational axis R. Multiple vanes 11 are arranged in a distribution over the circumference of the rotor 10. The vanes 11 are guided, such that they can be moved back and forth in the radial direction, in slot-shaped vane receptacles of the rotor 10 which are open at the outer circumference of the rotor 10. The vane receptacles extend radially, but could also be tilted or, if the vanes 11 are appropriately shaped, curved with respect to the radial direction, such that the extending and retracting movement of the vanes 11 or as applicable the curved vanes is a movement in the radial and/or tangential direction.

The pump is a dual-flux pump. The delivery space is correspondingly sub-divided into two delivery chambers, each comprising an inlet and an outlet. When the rotor is rotary-driven, fluid flows through the inlet on the low-pressure side of the respective flux, into the respective delivery chamber, and is expelled and discharged at an increased pressure through the respective outlet on the high-pressure side of the respective flux.

When the rotor 10 is rotary-driven, the vanes 11 are guided along the outside of a cam structure 5 which surrounds the rotor 10 about the rotational axis R, such that the vanes 11 retract deep into the vane receptacles of the rotor 10 in accordance with the guiding cam formed by the inner circumference of the cam structure 5. At sufficiently high rotational speeds, the vanes 11 are moved outwards by the centrifugal force, towards the guiding cam of the cam structure 5, such that sealing gaps formed between the vanes 11 and the cam structure 5 fluidically separate leading and trailing delivery cells, adjoining the relevant vane 11, from each other. In order to distinguish between the two fluxes, the delivery cells in one delivery chamber which increase in size on the low-pressure side and decrease in size on the high-pressure side are denoted by 6 and the delivery cells which increase in size on the low-pressure side and decrease in size on the high-pressure side as they pass through the other delivery chamber are denoted by 7.

In order that the vanes 11 extend even at low rotational speeds, pressure is applied to their lower sides near to the rotational axis R, in a sub-vane region 12 of the respective vane receptacle. In order to apply this pressure, a portion of the pressure fluid delivered by the pump is channelled into the sub-vane regions 12 in order to act on the lower sides of the vanes 11 and apply a pressure force to them which acts outwards in the direction of the guiding cam of the cam structure 5.

Figure 2:
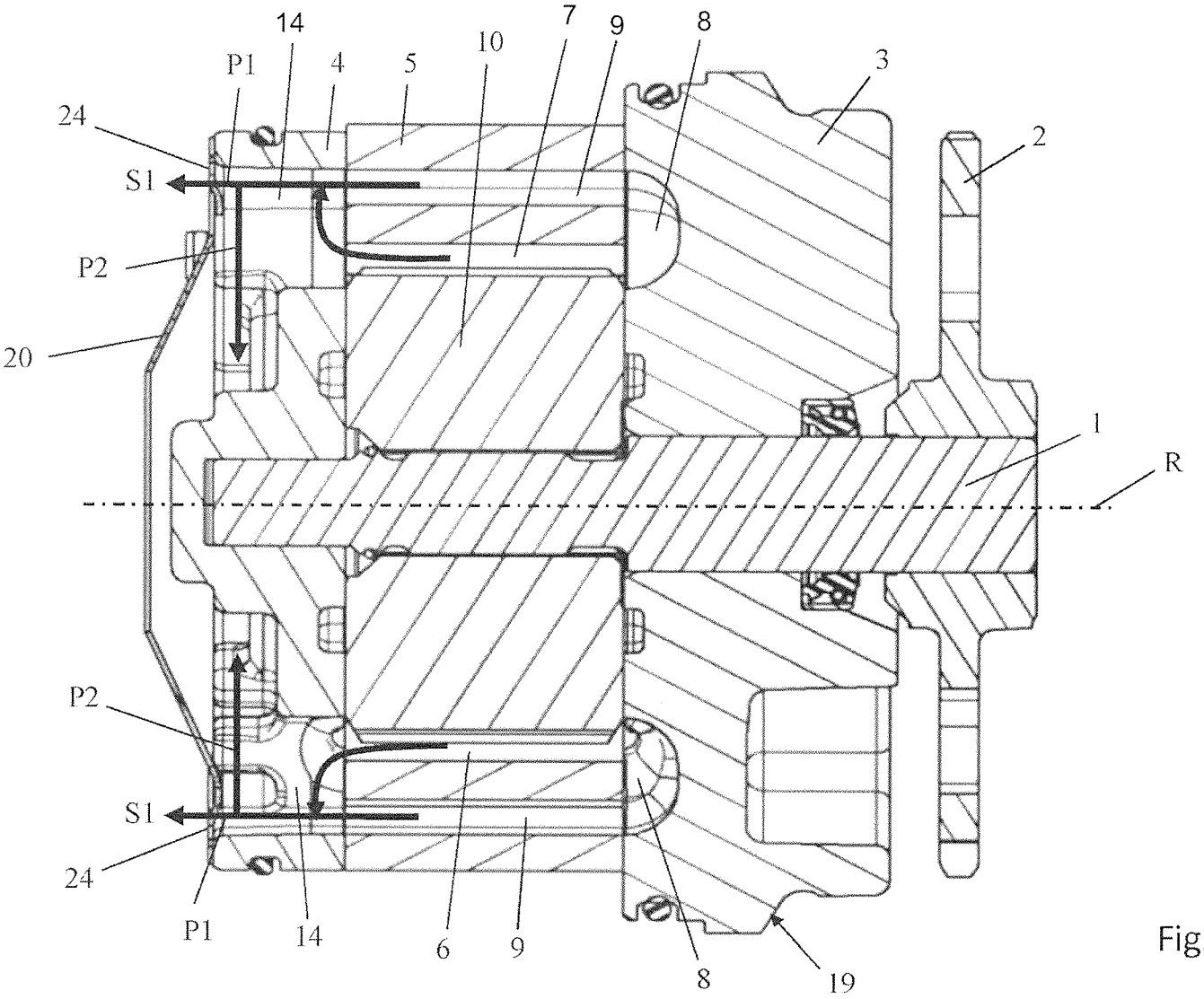
FIG. 2 the vane cell pump comprising a flow channelling device of a first example embodiment, in a longitudinal section.

FIG. 2 shows the vane cell pump in a longitudinal section. The housing of the pump comprises a housing part 3, an end plate 4 and the cam structure 5. The cam structure 5 is arranged axially between the housing part 3 and the end plate 4, such that the cam structure 5 surrounds the delivery space of the pump, and the end faces of the housing part 3 and end plate 4 which axially face each other axially enclose the delivery space on the two outer sides of the rotor 10.

As stated above, the cam structure 5 is part of the housing of the pump. In modifications, the cam structure 5 can be arranged, such that it can be moved back and forth, in a modified pump housing, in order to be able to adjust a specific delivery volume of the vane cell pump. In the dual-flux pump of the example embodiment, the cam structure 5 could be arranged such that it can be moved linearly relative to the rotor 10. Increasing the specific delivery volume of one flux would however be associated with a decrease in the specific delivery volume of the other flux. This correlation would not apply in mono-flux pumps. The cam structure 5 in mono-flux pumps could be arranged such that it can be linearly moved or pivoted relative to the rotor of a mono-flux pump, as is known in principle. By making the cam structure 5 a housing part, however, the pump can be embodied to exhibit smaller dimensions radially, and thus be embodied in a radially more compact way, as compared to a pump which can be adjusted in terms of its delivery volume.

In order to be rotary-driven, the rotor 10 is connected, in a way which transmits torque, to a drive shaft 1 which is driven via a drive wheel 2. The drive wheel 2 is correspondingly connected, in a way which transmits torque, to the drive shaft 1. The drive shaft 1 protrudes through the housing part 3 and also through the rotor 10, and its axial end protrudes into the end plate 4, such that the drive shaft 1 is rotatably supported on the housing of the vane cell pump on both sides of the rotor 10.

The pressure fluid on the high-pressure side can be discharged from the delivery chamber formed by the delivery cells 6 through a first pressure passage 14 which extends through the end plate 4. Another, second pressure passage 14, for discharging from the delivery chamber formed by the delivery cells 7, extends through the end plate 4. The pressure passages 14 extend axially in a straight line through the end plate 4. An axially straight pressure passage is advantageous in terms of fluid flowing off with as little loss as possible. The pressure passages 14, or also only one of the pressure passages 14, can in principle exhibit a different course through the end plate 4 and for example extend obliquely with respect to the axial direction.

An overflow channel 9 extends through the cam structure 5 in each of the circumferential regions in which the delivery cells 6 and the delivery cells 7 decrease in size. When the rotor 10 is rotary-driven, pressure fluid is delivered into overflow regions 8, formed axially opposite the pressure passages 14 in the housing part 3, on the high-pressure side of the respective delivery chamber. The overflow regions 8 are connected to the axially opposite pressure passage 14 via the overflow channels 9 which extend axially in the cam structure 5. This improves the effectiveness of the pump, since the pressure fluid is displaced at the two axial ends of the delivery cells 6 of one delivery chamber which decrease in size and the delivery cells 7 of the other delivery chamber which decrease in size and passes directly into the assigned pressure passage 14 at the end facing the end plate 4 and into the assigned pressure passage 14 via the respective overflow region 8 and subsequent overflow channel 9 at the axially opposite end and flows off through it.

On the end face of the end plate 4 facing away from the rotor 10, the vane cell pump comprises a flow channelling device 20 which forms a flow channelling region jointly with the end plate 4 and, in co-operation with the end plate 4, channels the pressure fluid downstream of the delivery space on the high-pressure side of the pump. The pressure fluid on the high-pressure side is channelled into and along different flow paths by means of the end plate 4 and the flow channelling device 20, before it flows off through outlet regions of the pump which are predetermined by the flow channelling device 20. Thus, a first partial flow S1 of the pressure fluid flowing out of the pressure passage 14 flows along a first flow path P1 through a first outlet region 24 of the flow channelling device 20. The first flow path P1 extends from an outlet opening of the pressure passage 14 which axially faces the flow channelling device 20 up to and into the first outlet region 24 of the flow channelling device 20 assigned to said pressure passage 14. The flow channelling device 20 comprises a first outlet region 24 for each flux, respectively, in axial alignment with the pressure passage 14 of the respective flux and/or delivery chamber.

The flow channelling device 20 is configured such that only a portion of the pressure fluid flowing out of the respective pressure passage 14 flows off over a short distance, i.e. along the respective flow path P1, through the assigned first outlet region 24, and another portion of the pressure fluid flowing out of the respective pressure passage 14 is channelled to the side directly next to the respective first outlet region 24, preferably—as in the example embodiment—in the direction of the rotational axis R, into a second flow path P2 which extends at least substantially transverse to the rotational axis R. The second flow path P2 extends between the end plate 4 and the flow channelling device 20. It is delineated by these two structures in the axial direction in each case.

Figure 3:
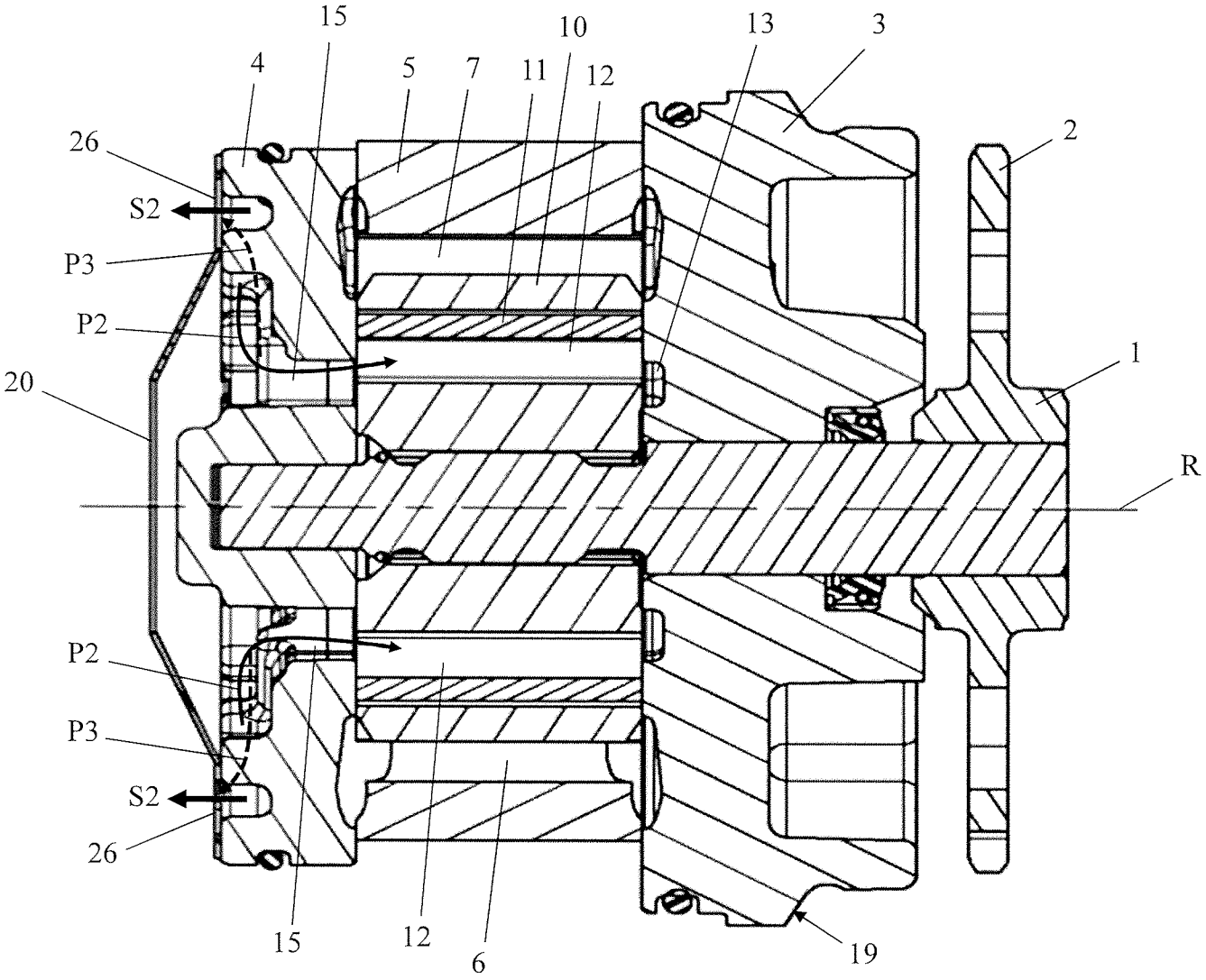
FIG. 3 the vane cell pump in another longitudinal section.

FIG. 3 shows the vane cell pump in another longitudinal section which extends through sub-vane regions 12 and is offset in the circumferential direction with respect to the first outlet regions 24 (FIG. 2). A portion of the second flow path P2 is shown for each of the two fluxes by means of a directional arrow, wherein the directional arrows denoted by P2 represent not only the second flow path P2 but are extended beyond the respective second flow path P2 up to and into the sub-vane region 12. In order to supply the sub-vane regions 12 with the pressure fluid and thus apply a pressure force to the lower sides of the vanes 11, multiple supply passages 15 extend through the end plate 4 and overlap with the sub-vane regions 12. When the rotor 10 is rotary-driven, a partial flow of the pressure fluid which is channelled into the second flow path P2 by means of the flow channelling device 20 flows to the supply passages 15 and through the supply passages 15 into the sub-vane regions 12. A sub-vane region connection 13 provided in the housing part 3 serves to disperse the pressure fluid into the sub-vane regions 12.

The second flow path P2 extends from the diversion point of the pressure fluid flowing out of the respective pressure passage 14 (FIG. 2) up to an inlet opening of the respective supply passage 15. If, as in the example embodiment, the end plate 4 comprises multiple supply passages 15, then the flow path which extends from the respective diversion up to an inlet opening of a supply passage 15 is designated as the second flow path P2. If multiple supply passages 15 are arranged sequentially as viewed from a first outlet region 24, then the second flow path P2 extends up to the nearest supply passage 15 in each case.

The partial flow diverted by means of the flow channelling device 20 disperses in the flow channelling region formed between the end plate 4 and the flow channelling device 20 and flows off, as the second partial flow S2, through a second outlet region 26 formed by the flow channelling device 20. At least a portion of the pressure fluid which ultimately flows off as the second partial flow S2 flows along the second flow path P2 into the sub-vane regions 12 before it also flows off through the second outlet region 26 as part of the second partial flow S2.

In the first example embodiment, the flow channelling device 20 is formed by a flow channelling structure which consists of one part and which is likewise identified in the following by the reference sign 20. The flow channelling device of the first example embodiment and/or the flow channelling structure 20 which forms it is positioned relative to the end plate 4 and fixed once positioned, i.e. cannot be moved relative to the end plate 4 when fitted. It can in particular, as in the example embodiment, abut the end face of the end plate 4 facing away from the rotor 10.

Figure 4:
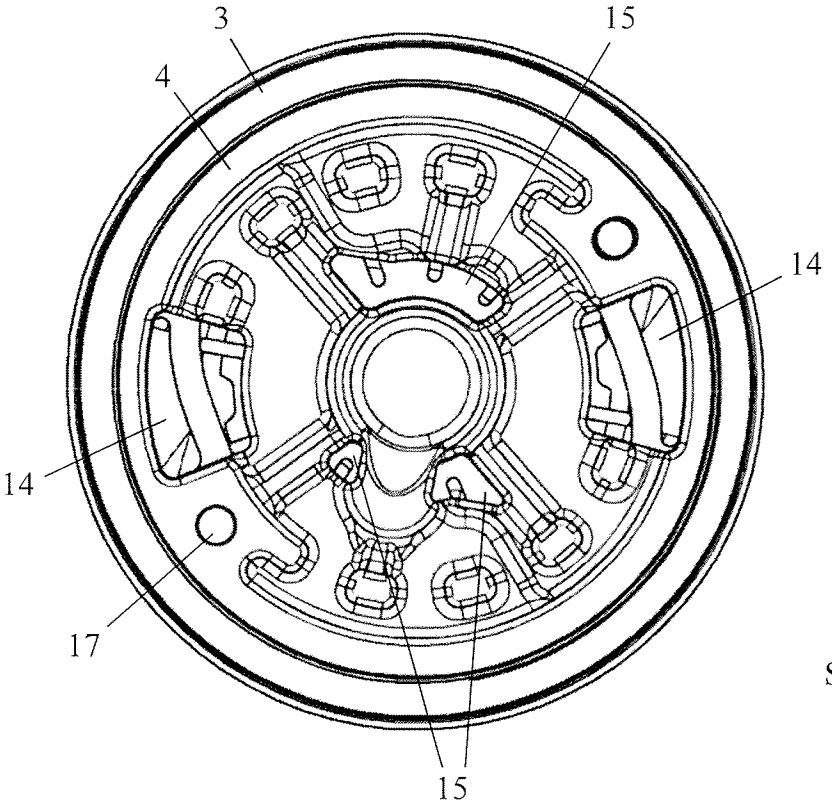
FIG. 4 the vane cell pump in an axial view onto an end plate.

FIG. 4 shows the vane cell pump in an axial view onto the end face of the end plate 4 facing away from the rotor 10. The flow channelling structure 20 has been removed, such that the outlet opening of the respective pressure passage 14 and the inlet opening of the respective supply passage 15 are exposed. Positioning elements which axially protrude on the end face of the end plate 4 are denoted by 17. The positioning elements 17 serve to position the flow channelling structure 20. They can in particular be shaped as pins or bolts.

Figure 5:
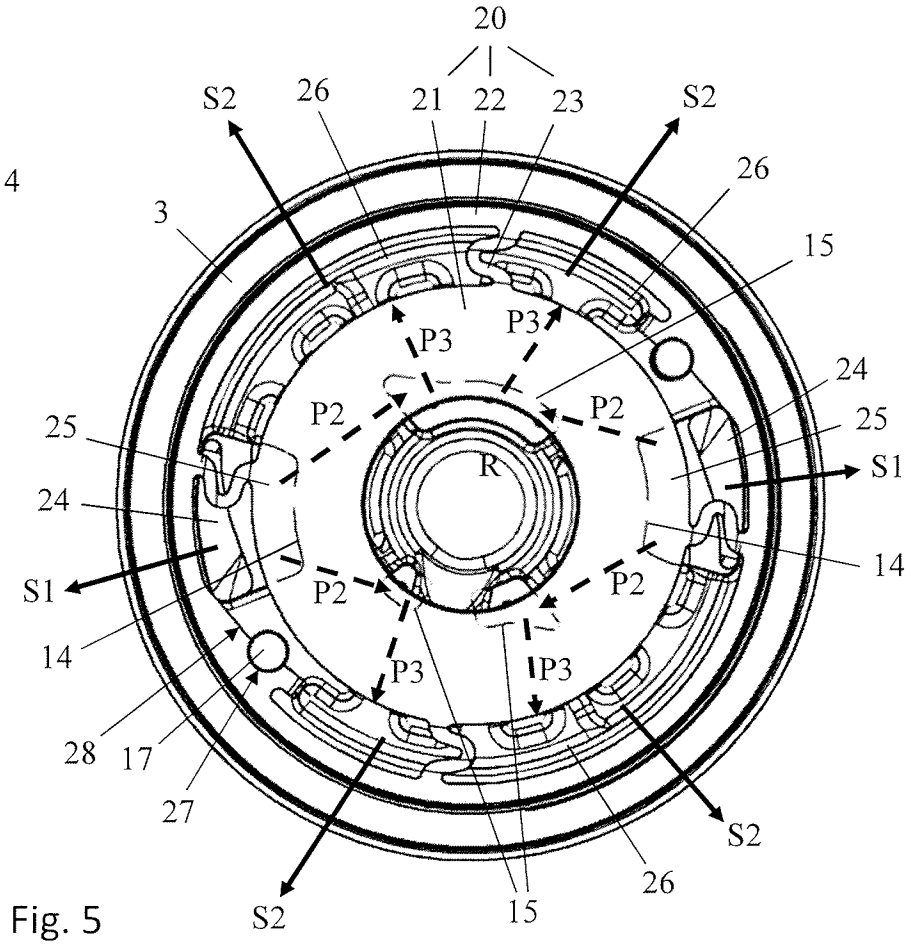
FIG. 5 the vane cell pump comprising the flow channelling device of the first example embodiment, in an axial view onto the flow channelling device.

FIG. 5 shows the vane cell pump in the same axial view as in FIG. 4, but with the flow channelling structure 20 positioned. For the purpose of positioning, positioning counter elements 27 formed on the flow channelling structure 20 are in a positioning engagement with the positioning elements 17. The flow channelling structure 20 axially abuts the end plate 4 and is secured against moving rotationally about the rotational axis R by the positioning engagement between the positioning elements 17 and the positioning counter elements 27. The positioning engagement can be a frictional fit in relation to the axial direction, such that the positioning elements 17 and the positioning counter elements 27 also form a retainer for the flow channelling structure 20.

When the pump is assembled, the flow channelling structure 20 is rotated relative to the end plate 4, into the positioning engagement between the positioning elements 17 and the positioning counter elements 27. During this relative rotation, the respective axially projecting positioning element 17 slides in the circumferential direction along a passant 28 formed on an inner circumference of the flow channelling structure 20, until it passes into a locking engagement with the positioning counter element 27 which follows the respective passant 28 in the circumferential direction. The positioning counter elements 27 are correspondingly each formed as a radial recess on the inner circumference of the flow channelling structure 20. Before being rotated into the positioning engagement, the flow channelling structure 20 expediently contacts the end plate 4 in the axial direction, i.e. the flow channelling structure 20 is expediently placed axially onto the end plate 4 and rotated into the positioning engagement in contact with the end plate 4. In the positioning engagement, the flow channelling structure 20 serves as a retainer for the axially stacked structure of the pump. The positioning elements 17 are joined to the housing part 3 and protrude axially upwards from it and through the cam structure 5 and the end plate 4, such that all the components of the pump from the housing part 3 up to the flow channelling structure 20 are held together by the clamping positioning engagement.

FIG. 5 shows the second flow paths P2, along which the pressure fluid which is deflected and thus diverted by means of the flow channelling structure 20 flows from the pressure passages 14 to the supply passages 15, and also third flow paths P3 using directional arrows. The pressure fluid flows along the third flow paths P3 from the supply passages 15 up to the second outlet regions 26. In addition, pressure fluid also flows from the pressure passages 14 to the second outlet regions 26 by bypassing the supply passages 15. For the sake of clarity, these flows are not indicated. The directional arrows for the flow paths P2 and P3 show how a partial flow of the pressure fluid flowing out of the pressure passages 14 is diverted by means of the flow channelling structure 20, and at least a portion of this partial flow is channelled along the second flow paths P2 to the supply passages 15 in order to ultimately flow off along the third flow paths P3 and through the second outlet regions 26 in the second partial flow S2. As a result, the pressure fluid delivered by the pump is discharged directly over a short distance through the first outlet region 24 of the respective flux in a first partial flow S1 and through the second outlet regions 26 in a remaining second partial flow S2 after being deflected and/or diverted, thus ensuring a supply to the sub-vane region 12, by means of the flow channelling structure 20.

The pump comprises one first outlet region 24 for each flux. The second outlet regions 26 cannot each be definitively assigned to one of the two fluxes. They can also be regarded as a single second outlet region 26 for both fluxes. Wherever a/the first outlet region 24 and a/the second outlet region 26 is mentioned in the following, this is intended to denote a first outlet region 24 and a second outlet region 26 of one flux. Wherever multiple first outlet regions 24 and/or second outlet regions 26 are concerned, such outlet regions are mentioned in the plural. Otherwise, the statements made with respect to each of a first outlet region 24, a second outlet region 26, a pressure passage 14 and a supply passage 15 also similarly apply to one or more other outlet regions 24 and 26 and pressure passages 14 and supply passages 15.

The first outlet regions 24 and second outlet regions 26 can be formed as a single axial passage or as multiple mutually separate axial passages of the flow channelling structure 20. If a mono-flux pump were to comprise only one first outlet region 24 and one second outlet region 26, these outlet regions 24 and 26 could also be formed as a single axial passage or as two mutually separate axial passages of a correspondingly adapted flow channelling structure. It would also be possible to provide multiple first outlet regions 24 and multiple second outlet regions 26, which are separated from each other, for each of one or more fluxes. This also applies analogously to mono-flux pumps. In the example embodiment, the second outlet regions 26 directly adjoin the first outlet regions 24. In modifications, the outlet regions 24 and 26 can however as mentioned also be separated from each other, in that a structural region of the flow channelling structure 20 which the pressure fluid cannot flow through extends between a first outlet region 24 and a second outlet region 26.

The first outlet regions 24 lie in axial alignment with the outlet openings of the pressure passages 14, such that the first outlet region 24 of one flux overlaps with the outlet opening of the pressure passage 14 of the same flux, and the other first outlet region 24 overlaps with the outlet opening of the pressure passage 14 of the other flux, as viewed axially. The pressure passages 14 and first outlet regions 24 of the two fluxes lie diametrically opposite each other across the rotational axis R, i.e. they are offset by about 180° in the circumferential direction with respect to each other. Due to the axial overlap, the pressure fluid flowing through the respective pressure passage 14 can flow axially out through the outlet opening of the pressure passage 14 flow axially off over a short distance to and through the assigned first outlet region 24.

In each of the fluxes, however, the first outlet region 24 only overlaps some of the axially opposite outlet opening of the assigned pressure passage 14. Only a portion of the pressure fluid flowing through the respective pressure passage 14 therefore flows off through the axially opposite first outlet region 24. Another portion flows against an axially opposite deflecting region 25 of the flow channelling structure 20 and is thus deflected to the side, transverse to the rotational axis R and inwards as viewed axially, towards the inlet openings of the supply passages 15. The deflecting region 25, over which the flow channelling device and/or structure 20 overlaps the outlet opening of the respective pressure passage 14, is situated between the first outlet region 24 of the respective flux of the pump and an inlet opening of the supply passages 15, in an axial plan view. In other words, the flow channelling structure 20 respectively overlaps an inner planar region, near to the rotational axis R, of the outlet opening of the respective pressure passage 14. A substantial portion of the deflected partial flow flows along the second flow path P2 to the nearest inlet opening of the supply passages 15 and through the latter into the sub-vane region 12 (FIG. 3). Another portion of the pressure fluid flowing out of the pressure passages 14 flows through the flow channelling region formed by the end plate 4 and the flow channelling structure 20, in order to then likewise flow off from the pump via the second outlet region or regions 26. As a result, the flow channelling structure 20 channels the pressure fluid delivered by the pump in such a way that the first partial flow S1 is discharged over a short distance, with little resistance, through the first outlet region 24 of the respective flux, while a second partial flow is deflected and discharged via one or more second outlet regions 26 as the second partial flow S2. As viewed axially, the flow channelling structure 20 is configured in relation to the position, shape and size of the respective first outlet region 24 such that the flow is deflected and consequently divided into the partial flows such that the sub-vane region 12 is supplied with the pressure fluid even at low rotational speeds of the pump, and pressure is applied to the lower sides of the vanes 11.

As can be seen in FIG. 5, the flow channelling structure 20 comprises a channelling region 21 on its radially inner side and a positioning region 22 on its radially outer side. The positioning region 22 is annular and surrounds the channelling region 21. An annular strip-shaped passage which remains between the channelling region 21 and the positioning region 22 forms the first outlet regions 24 and the second outlet regions 26 which lie between them in the circumferential direction. This results in the following sequence in the circumferential direction: first outlet region 24—second outlet region 26—first outlet region 24—second outlet region 26, wherein the first outlet regions 24 and second outlet regions 26 directly adjoin each other respectively and also transition smoothly into each other in their boundary regions. On its radially inner side, and adjoining the respective first outlet region 24, the channelling region 21 forms the deflecting region 25 at which the pressure fluid leaving the assigned pressure passage 14 is deflected into one of the second flow paths P2 and thus towards the supply passages 15 in each case. The flow channelling structure 20 also comprises multiple connecting elements 23 which connect the channelling region 21 to the positioning region 22. The connecting elements 23 each bridge the annular strip-shaped passage of the flow channelling structure 20. The connecting elements 23 are spaced from each other in the circumferential direction. They act as spring elements and are sinuous in order to improve their spring action. When not exposed to a load, the channelling region 21 can spring-deflect relative to the positioning region 22 in the axial direction. When fitted, the positioning region 22 axially abuts the end plate 4, while the channelling region 21 exhibits an axial distance from the end plate 4.

The channelling region 21 spring-deflects axially towards the end plate 4 when an axial pressure force acts on the channelling region 21. In this way, the flow channelling structure 20 acts as a spring device—in the example embodiment, it is embodied as a disc spring exhibiting a spring direction parallel to the rotational axis of the rotor 10. The flow channelling structure 20 serves to facilitate fitting the vane cell pump which is embodied as a cartridge pump in an installation space provided for the pump, for example in an installation space of a transmission which is to be supplied with the pressure fluid by the vane cell pump. The vane cell pump is inserted axially into the adapted installation space in a comparable way to a cartridge, with the flow channelling structure 20 first, until the flow channelling structure 20 abuts against a rearward end wall of the installation space which is embodied as a blind space. If pressure is applied axially, the flow channelling structure 20 spring-deflects until a securing region 19 of the housing part 3, which can be seen in FIGS. 2 and 3, passes behind an annular securing element which is arranged in a front region of the installation space in order to axially secure the pump once installed. Once installed, the spring-deflected flow channelling structure 20 presses the pump axially against the securing element, such that the pump is axially clamped in its secured state. The securing element is usually provided at the point of installation, but could instead also be part of the pump if conditions were reversed. The securing element can for example be a slotted spring washer. The pump in accordance with the invention can for example be arranged in an installation space of the pump or can be provided for being arranged in this way, as is known from DE 10 2015 105 928 A1.

The flow channelling structure 20 comprises a central passage. Once installed, the flow channelling structure 20 presses with a spring force against a rearward end wall of the installation space, such that leakage fluid can only leave the flow channelling region through the central passage. In modified embodiments, the flow channelling structure can be closed in its central region or can comprise a comparatively far smaller central passage in order to prevent fluid from flowing off in this region and the reliability of supply to the sub-vane region 12 being consequently reduced, even irrespective of the installation circumstances.

In alternative embodiments, a drainage channel for the pressure fluid can be provided in an end wall of the installation space which the flow channelling structure 20 axially abuts when fitted, and the flow channelling structure 20 can comprise the central passage which in these embodiments forms a third outlet region of the flow channelling structure 20. Pressure fluid flowing off through the third outlet region can advantageously be drained separately from the rest of the pressure fluid, in order for example to supply particular points or regions of a transmission or engine gallery with the pressure fluid. This can optimise the flow routes to the points of consumption.

Figure 6:
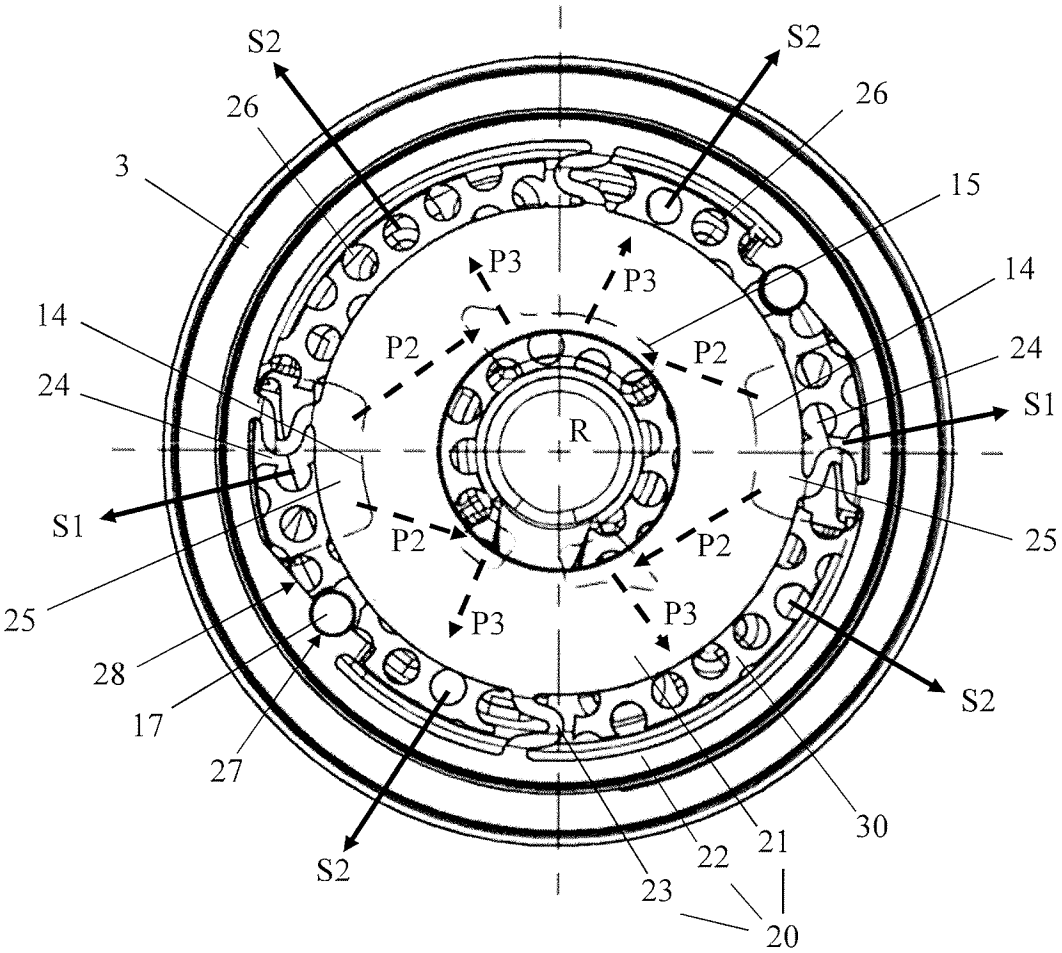
FIG. 6 the vane cell pump comprising a flow channelling device of a second example embodiment, in an axial view onto the flow channelling device.
Figure 8:
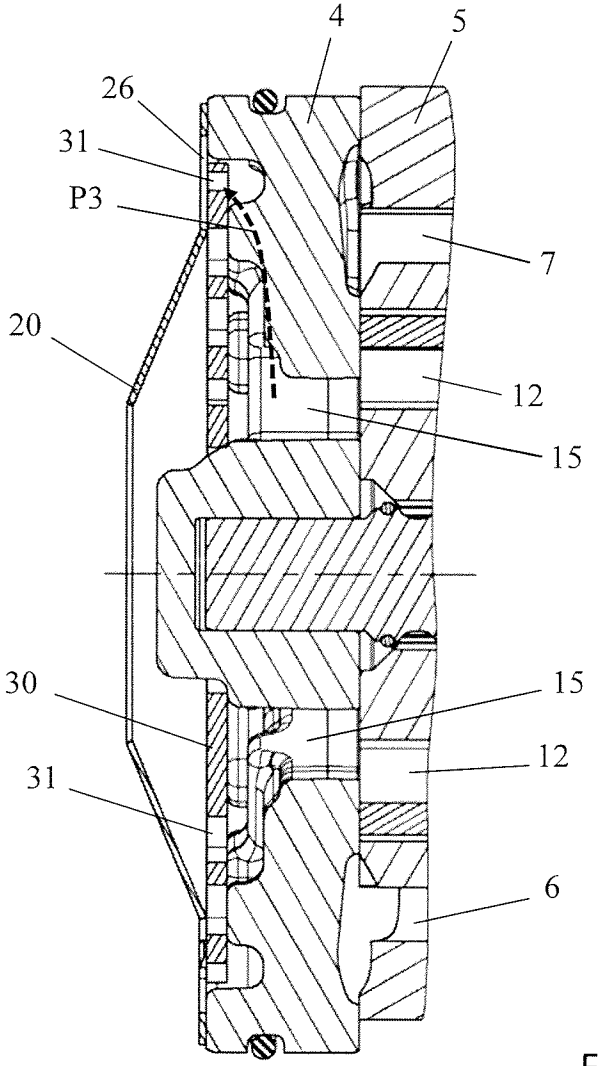
FIG. 8 the end plate and the flow channelling device of the second example embodiment, in another longitudinal section.
Figure 7:
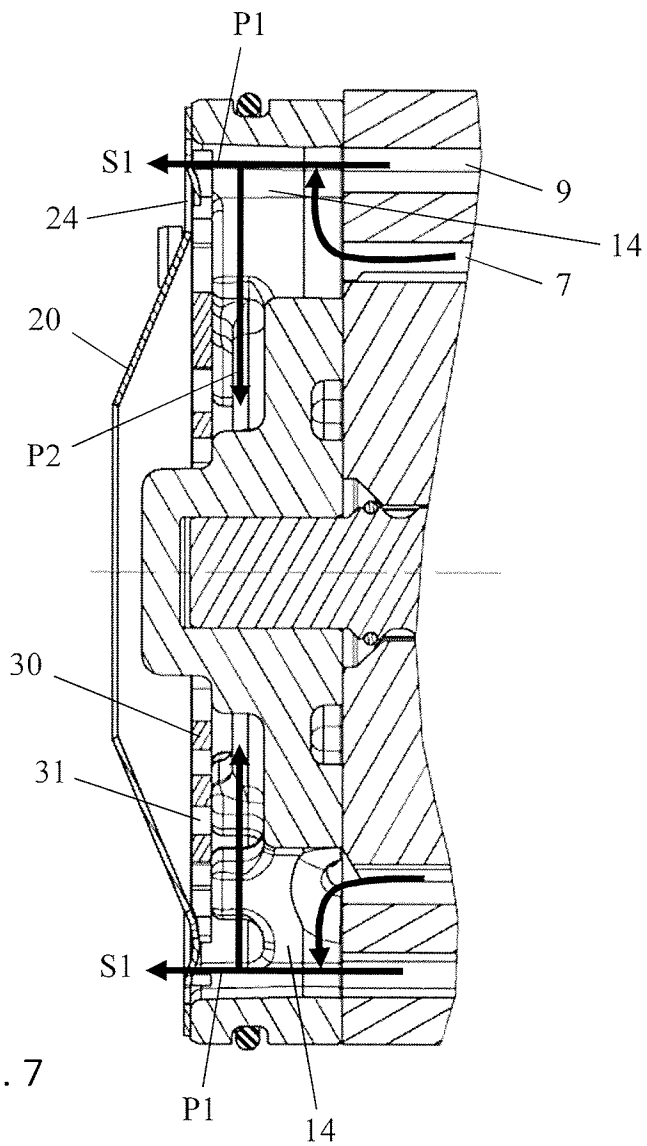
FIG. 7 the end plate and the flow channelling device of the second example embodiment, in a longitudinal section.

FIGS. 6 to 8 show a vane cell pump comprising a flow channelling device of a second example embodiment. FIG. 6 shows the vane cell pump in a plan view onto the flow channelling structure 20, and FIGS. 7 and 8 show the pump in longitudinal sections which are offset in the circumferential direction with respect to each other. Except for the modified flow channelling device, the vane cell pump corresponds to the pump shown in FIGS. 1 to 5, such that substantially only the modified flow channelling device will be described and reference is otherwise made to the statements above in relation to the vane cell pump, wherein the same reference signs are used for the corresponding components of the pump as in the foregoing.

The flow channelling device of the second example embodiment comprises a flow channelling structure 20 and additionally a resistance structure 30, which jointly form the flow channelling device 20, 30 of the second example embodiment. The flow channelling structure 20 corresponds to the flow channelling structure 20 of the first example embodiment, such that reference is also made to the statements above in this regard, wherein the same reference signs are used as in the foregoing.

The resistance structure 30 increases the flow resistance of the third flow path P3 as a ratio of the flow resistance of the second flow path P2 as compared to the first example embodiment. This even more reliably ensures that the sub-vane region 12 (FIGS. 1 to 3) is supplied with sufficient pressure fluid even at low rotational speeds. The resistance structure 30 is arranged in the flow path of the partial flow S2 which flows off through the respective second outlet region 26 downstream of the respective supply passage 15, upstream of the respective outlet region 26 as is preferred, and particularly preferably immediately before the respective outlet region 26. In preferred embodiments, the pressure fluid flowing off through the respective second outlet region 26 flows through the resistance structure 30 immediately upstream of the second outlet region 26 formed by the flow channelling structure 20.

In order to even more reliably ensure a supply to the sub-vane region 12, the flow resistance of the first flow path P1 as a ratio of the flow resistance of the second flow path P2 can also be increased as compared to the first example embodiment. In the second example embodiment, this measure is implemented by the resistance structure 30 also increasing the flow resistance immediately upstream of the first outlet region 24 of the respective flux. The first partial flow S1 flows through the resistance structure 30 immediately before it flows off through the respective first outlet region 24.

The resistance structure 30 forms a shutter in the respective flow path P1 and/or P3—in the example embodiment, in the flow paths P1 and P3—wherein said shutter comprises multiple passages 31, which in the example embodiment are circular passage holes, through which the pressure fluid has to flow in order to then be able to flow off through the respective outlet region 24 or 26. The additional flow resistance as compared to the first example embodiment, provided by means of the resistance structure 30, is dependent on the ratio of the area of the passages 31 to the area of the closed regions of the resistance structure 30 which fluid cannot flow through. It is therefore possible to vary the flow resistance of the respective flow path P1 and/or P3 by changing the number and/or cross-sectional areas of the passages 31, in order on the one hand to ensure a supply to the sub-vane region 12 and on the other to impair the effectiveness of the pump as little as possible.

The resistance structure 30 is an axially thin, planar structure. In the example embodiment, it is a disc. It can be planar as in the example embodiment or instead bowl-shaped and for example shaped to conform to the shape of the flow channelling structure 20.

The flow channelling structure 20 and the resistance structure 30 are produced separately from each other. They can be fitted together or successively. The resistance structure 30 is arranged between the end plate 4 and the flow channelling structure 20. It can in particular be arranged directly between the end plate 4 and the flow channelling structure 20, as in the example embodiment. It sub-divides the flow channelling region formed between the end plate 4 and the flow channelling structure 20 into an inner channelling region situated between the end plate 4 and the resistance structure 30 and an outer channelling region situated between the resistance structure 30 and the flow channelling structure 20. The pressure fluid flowing out of the respective pressure passage 14 has to flow through the resistance structure 30 in order to be able to pass into the outer channelling region and flow off through the outlet regions 24 and 26.

Figure 9:
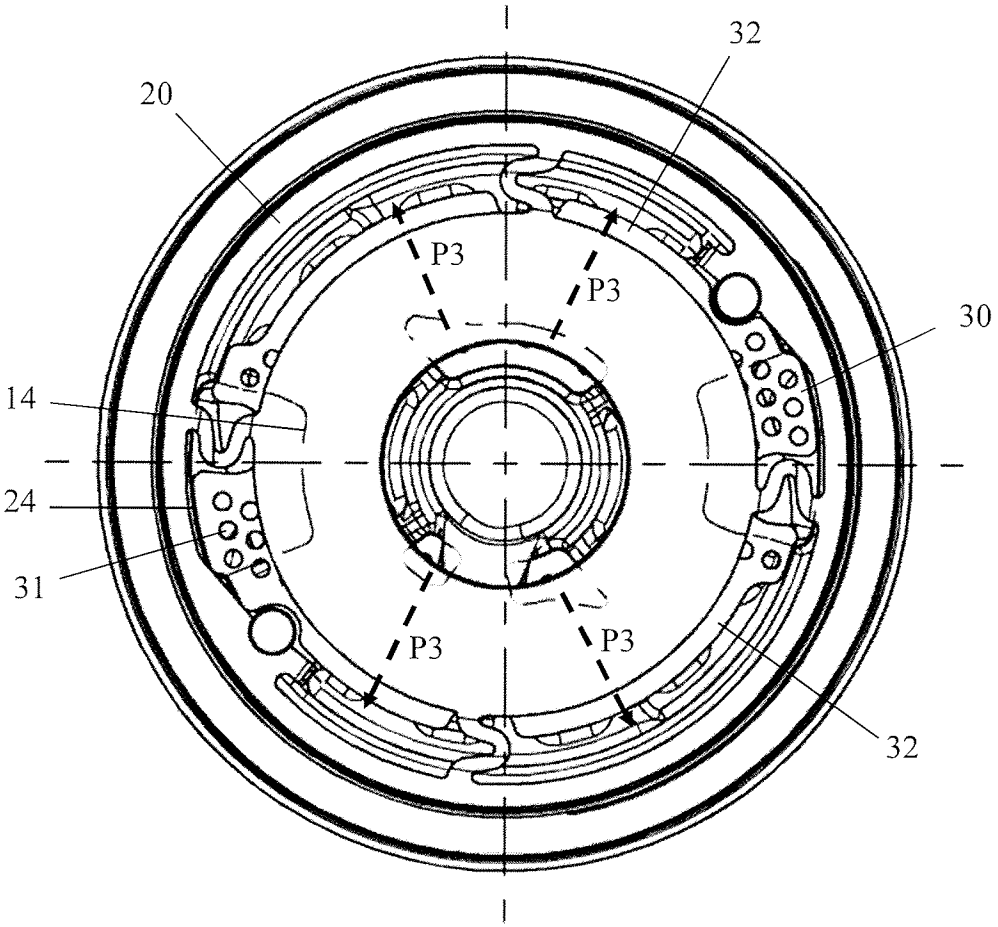
FIG. 9 the vane cell pump comprising a flow channelling device of a third example embodiment, in an axial view onto the flow channelling device.
Figure 11:
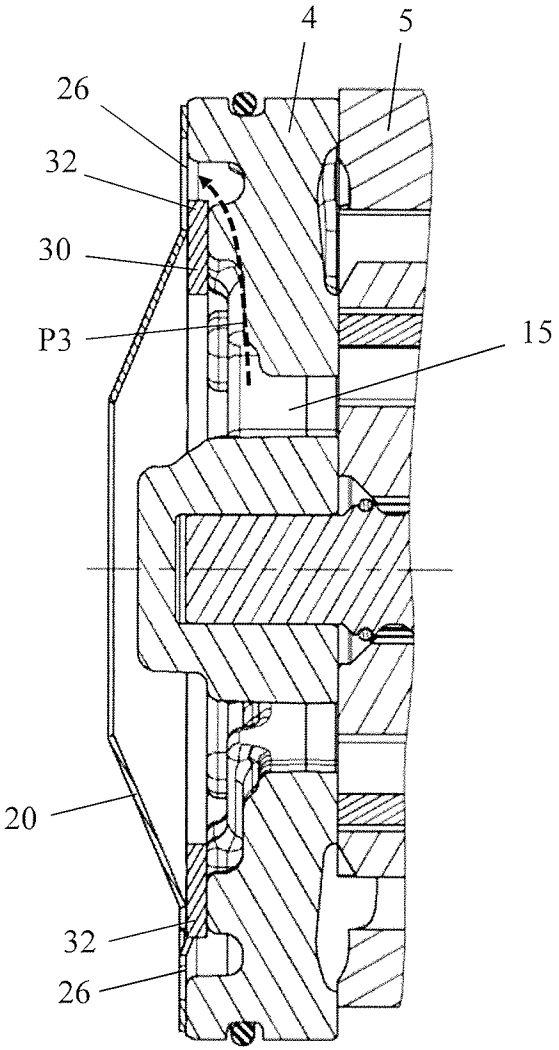
FIG. 11 the end plate and the flow channelling device of the third example embodiment, in another longitudinal section.
Figure 10:
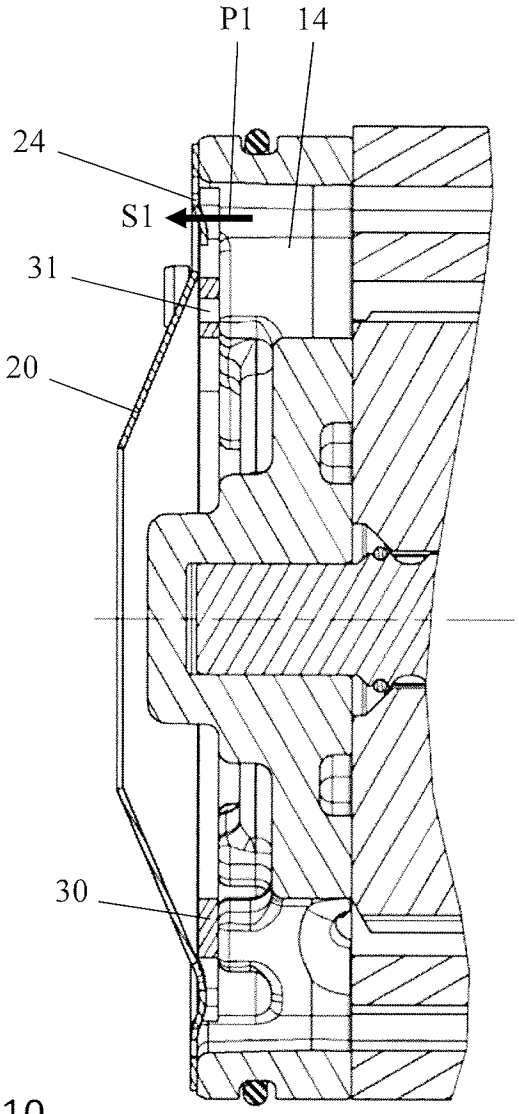
FIG. 10 the end plate and the flow channelling device of the third example embodiment, in a longitudinal section.

FIGS. 9 to 11 show a vane cell pump comprising a flow channelling device of a third example embodiment. Aside from the flow channelling device, the vane cell pump corresponds to the pump shown in FIGS. 1 to 5, such that reference is made to the statements in the foregoing, wherein the reference signs from the foregoing are also used.

The flow channelling device of the third example embodiment is derived from the flow channelling device of the second example embodiment. The flow channelling structure 20 corresponds to the flow channelling structure 20 of the two preceding example embodiments. The flow channelling device comprises a resistance structure 30 featuring multiple passages 31 which are each arranged in a planar region of the resistance structure 30 which is in axial overlap with the first outlet region 24 of the respective flux. To this extent, the resistance structure 30 corresponds to that of the second example embodiment. Unlike the second example embodiment, however, the resistance structure 30 does not comprise any passages in the region of the second outlet region 26 of the respective flux, but rather a closed resistance surface 32 which, in a plan view, is extended radially outwards and overlaps with the outlet region 26 of the respective flux in the plan view, i.e. axially, and around which the respective partial flow S2 has to flow before it can flow off through the respective second outlet region 26.

In one modification (not shown), a comparable resistance surface 32 could also be provided in axial overlap with the respective first outlet region 24, instead of the passages 31, and could increase the size of the deflecting region 25 of the first example embodiment which directly adjoins the outlet region 24 and correspondingly decrease the size of the cross-section of the outlet region 24. In another modification, the resistance structure 30 in axial overlap with the respective second outlet region 26 can comprise passages 31 as in the second example embodiment and a closed resistance surface 32 in axial overlap with the respective first outlet region 24.

In the second and third example embodiments, the resistance structure 30 is embodied in the manner of a shutter. In relation to setting the flow resistances of the flow paths P1, P2 and P3, a comparable result can also be achieved using a modified resistance structure, for example by forming the modified resistance structure as a sieve, fabric or other mesh. It is also possible to axially stack multiple singular and/or single-ply mesh structures, for example multiple singular and/or single-ply sieves, which jointly form the modified resistance structure. In yet other modified embodiments, the resistance structure can be composed of one or more partial regions which fluid cannot flow through and one or more partial regions which fluid can flow through, wherein the partial region(s) which fluid can flow through is/are situated in the first flow path P1 and/or in the third flow path P3, in order to increase the flow resistance of the respective flow path. The partial region(s) which fluid can flow through can (each) be formed as a shutter or mesh.

Figure 12:
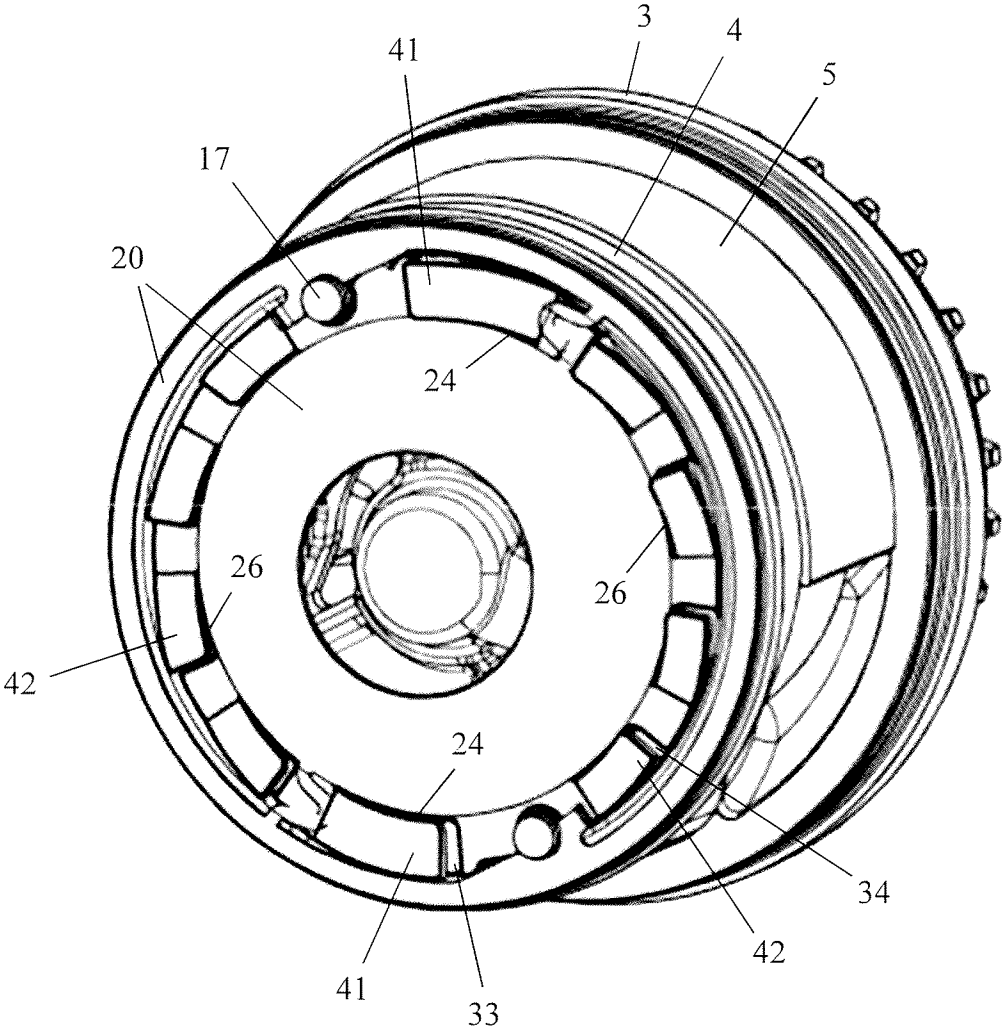
FIG. 12 the vane cell pump comprising a flow channelling device of a fourth example embodiment, in an isometric representation.
Figure 14:
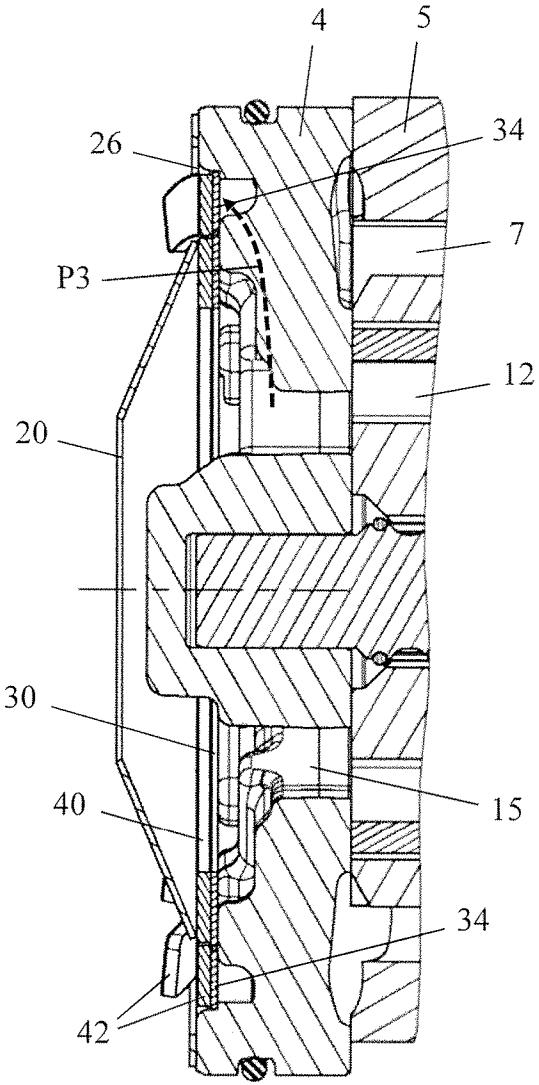
FIG. 14 the end plate and the flow channelling device of the fourth example embodiment, in another longitudinal section.
Figure 13:
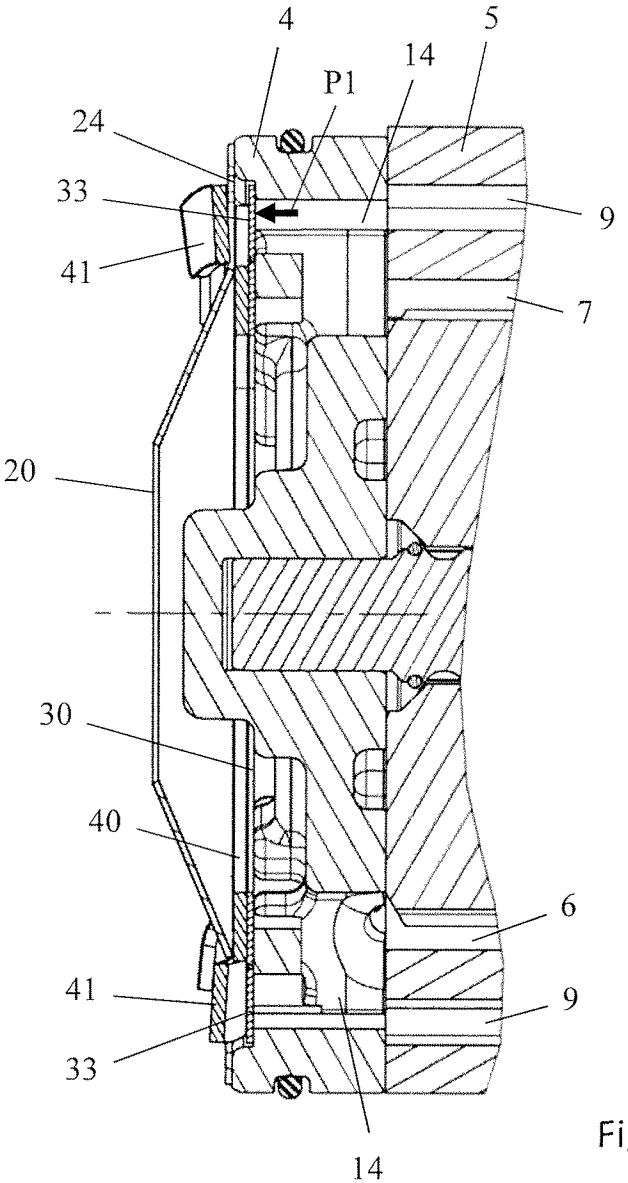
FIG. 13 the end plate and the flow channelling device of the fourth example embodiment, in a longitudinal section.

FIGS. 12 to 14 show a vane cell pump comprising a flow channelling device of a fourth example embodiment. The vane cell pump corresponds to the vane cell pump of the above example embodiments, such that reference is made to the statements made in this respect, wherein the same reference signs as in the first example embodiment are used for the same components of the pump.

The flow channelling device of the fourth example embodiment comprises a flow channelling structure 20 which corresponds to the flow channelling structure 20 of the above example embodiments, such that reference is again made to the statements made in this regard in the foregoing. Unlike the above example embodiments, the flow channelling device forms a valve device comprising moving valve elements for controlling the discharge of fluid through both the first outlet region 24 and the second outlet region 26 of the respective flux of the pump. The valve device comprises valves which are arranged in a distribution in the circumferential direction. The flow channelling device can then in particular comprise one valve for the first outlet region 24 of the respective flux and multiple valves for the second outlet region 26 of the respective flux, as in the example embodiment. The valves each comprise a moving valve element and an abutment, specifically a valve element 33 and an abutment 41, for the first outlet region 24 of the respective flux and multiple valve elements 34 and corresponding abutments 42 for the second outlet region 26 of the respective flux. The moving valve elements 33 and 34 can be moved back and forth between a closed position and an aperture position which is predetermined by the respectively assigned abutment 41 and 42. When the pressure fluid is applied to it, the respective valve element is moved axially outwards towards the aperture position, until it abuts the assigned abutment.

FIGS. 13 and 14 show the region of the vane cell pump which comprises the flow channelling device, as in the other example embodiments, in a longitudinal section in each case. The pressure passages 14 together with the respectively assigned valve element 33 can be seen in the longitudinal section in FIG. 13. The longitudinal section in FIG. 14 shows the supply passages 15 and the moving valve elements 34 which are arranged immediately before the second outlet region 26. The valve elements 33 and 34 have each assumed the closed position in FIGS. 13 and 14.

The valves are each formed in the manner of a Reed valve. The valve elements 33 and 34 are spring tongues which each protrude from a root region in the circumferential direction and can be elastically bent away from the end plate 4 towards the respectively assigned abutment, i.e. towards the aperture position.

While the pump is in operation, the delivered pressure fluid is applied to the valve elements 33 and 34 in the direction of the aperture position. The elastic restoring force of the valve elements 33 and 34 counteracts the pressure of the pressure fluid. The elastic restoring force can in particular be dimensioned such that the valve elements 33 and/or 34 are only moved out of the closed position towards the aperture position once a particular minimum rotational speed has been reached, such that the pressure fluid does not yet flow off through the outlet regions 24 and/or 26 until the minimum rotational speed is reached, but is rather channelled into the sub-vane region 12. Because the flow channelling device forms a valve device, it is possible to improve a supply to the sub-vane region 12 at particularly low pump speeds.

The valve elements 33 and 34 are part of a planar resistance structure 30 which can in particular be embodied as a thin annular structure, as in the example embodiment. The resistance structure 30 can be planar or also bowl-shaped, as in the example embodiment. It can in particular be produced from spring steel or from other metals, or in principle also from a plastic material, as long as the respective material enables the dimensionally elastic valve elements 33 and/or 34 to be formed.

The abutments 41 and 42 are parts of an abutment structure 40 which is likewise regarded as part of the flow channelling device. The abutment structure 40 is a planar structure—in the example embodiment, an annular structure. It is shaped as a planar annular disc in the example embodiment, but can in principle also be bowl-shaped in conformity with the flow channelling structure 20, wherein the resistance structure 30 would also be correspondingly shaped in such embodiments.

The flow channelling device 20, 30, 40 is structured in layers, as in the second and third example embodiments; unlike these two example embodiments, it comprises the abutment structure 40 as an additional layer. The resistance structure 30 abuts the end face of the end plate 4. The abutment structure 40 is arranged axially between the resistance structure 30 and the flow channelling structure 20 which is arranged on the axially outer side. When the positioning elements 17 and the positioning counter elements 27 are in positioning engagement, the flow channelling structure 20 holds the flow channelling device 20, 30, 40, which consists of multiple parts, on the end plate 4, as in the other example embodiments. The resistance structure 30 and the abutment structure 40 can likewise be in a positioning engagement with the same positioning elements 17, in order to position these two structures relative to the respective pressure passage 14 and supply passage 15 in the circumferential direction.

Figure 15:
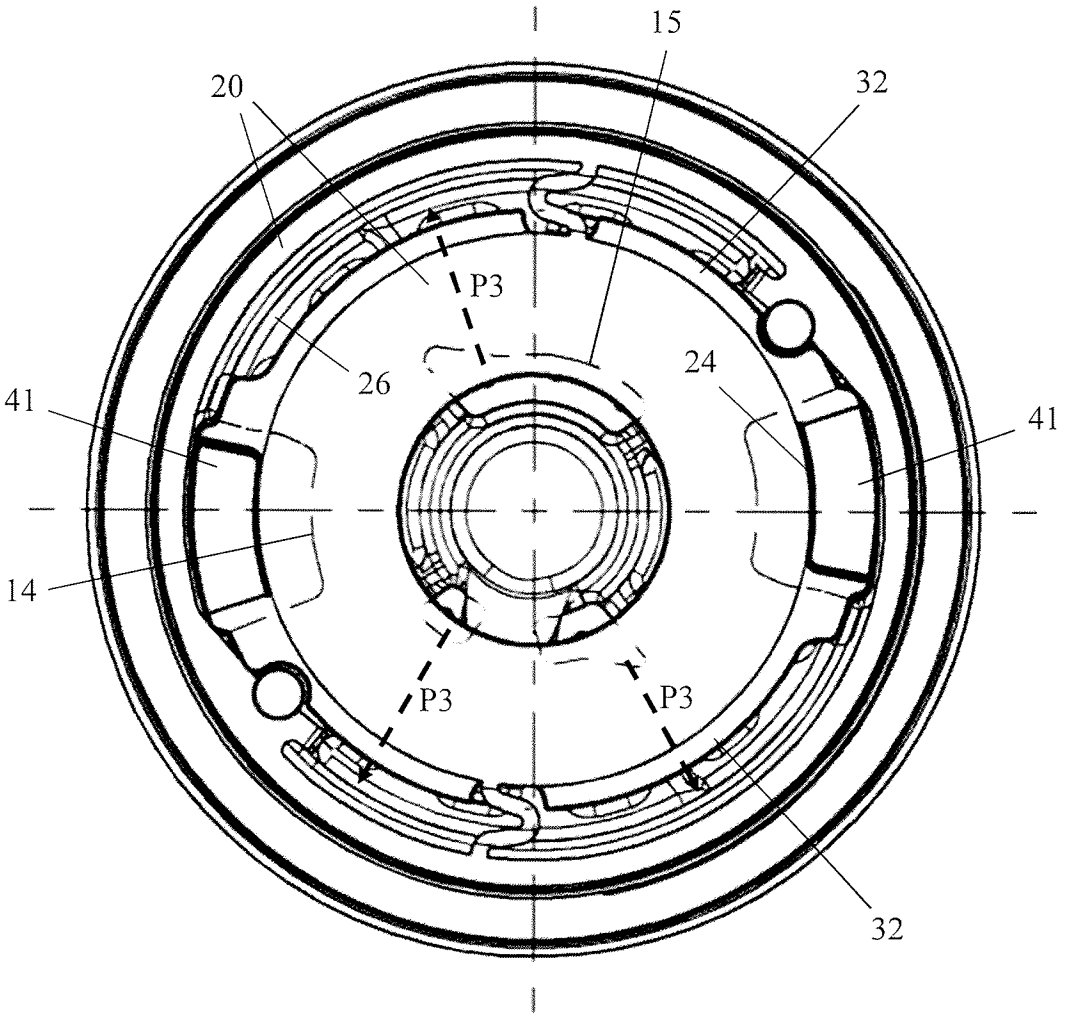
FIG. 15 the vane cell pump comprising a flow channelling device of a fifth example embodiment, in an axial view onto the flow channelling device.
Figure 17:
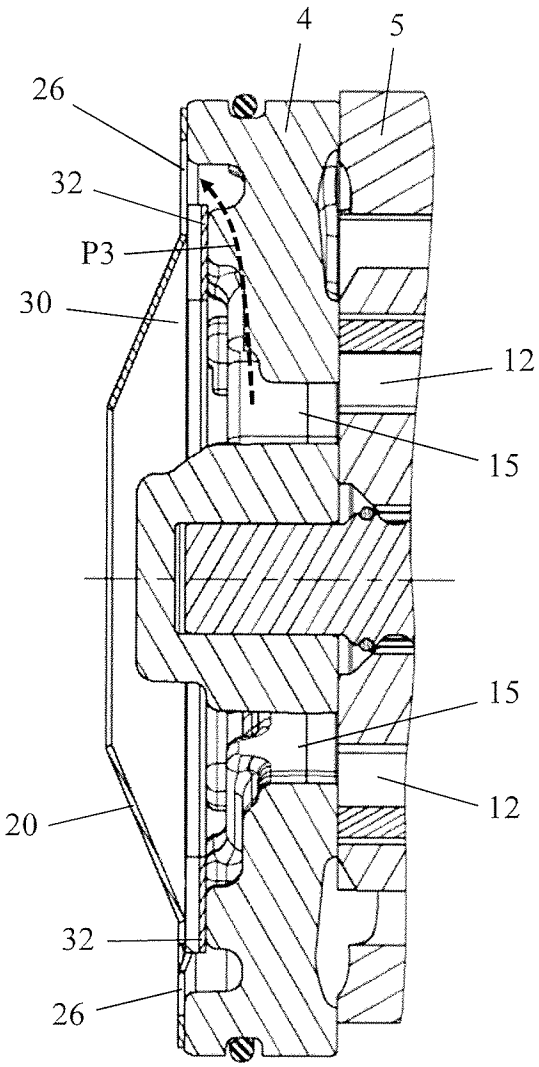
FIG. 17 the end plate and the flow channelling device of the fifth example embodiment, in another longitudinal section.
Figure 16:
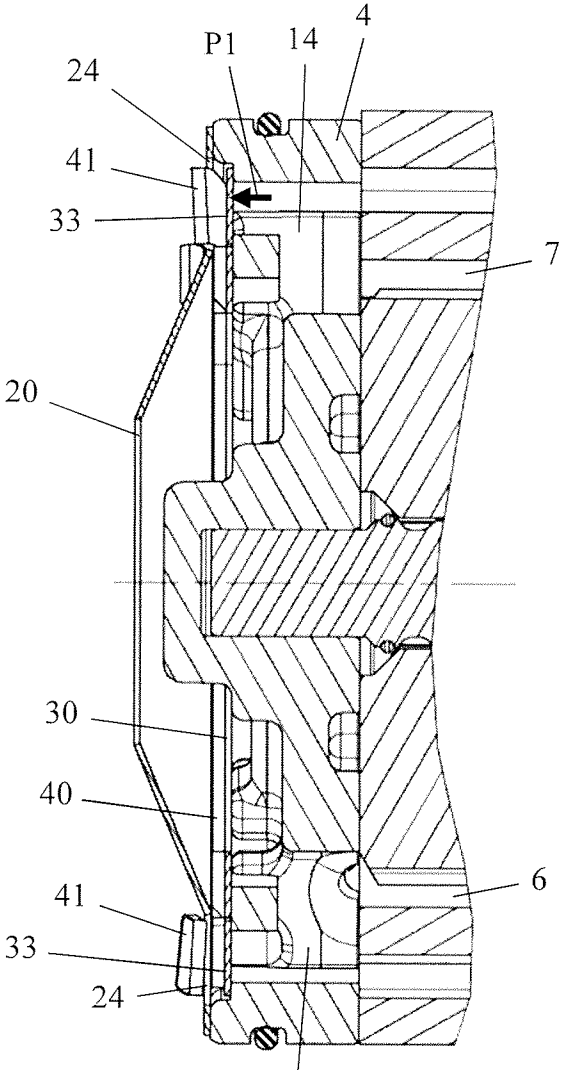
FIG. 16 the end plate and the flow channelling device of the fifth example embodiment, in a longitudinal section.
Figure 19:
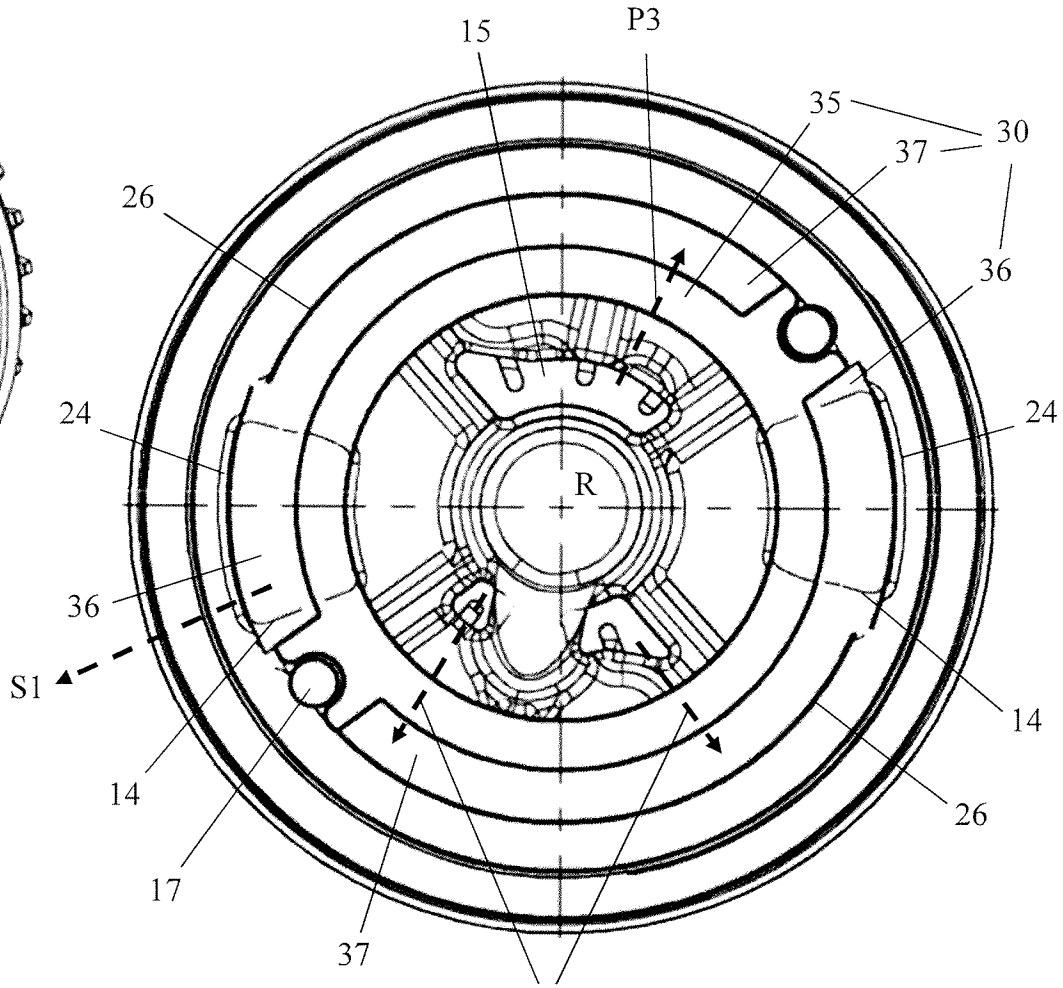
FIG. 19 the vane cell pump in an axial view onto a resistance structure of the flow channelling device of the sixth example embodiment.
Figure 18:
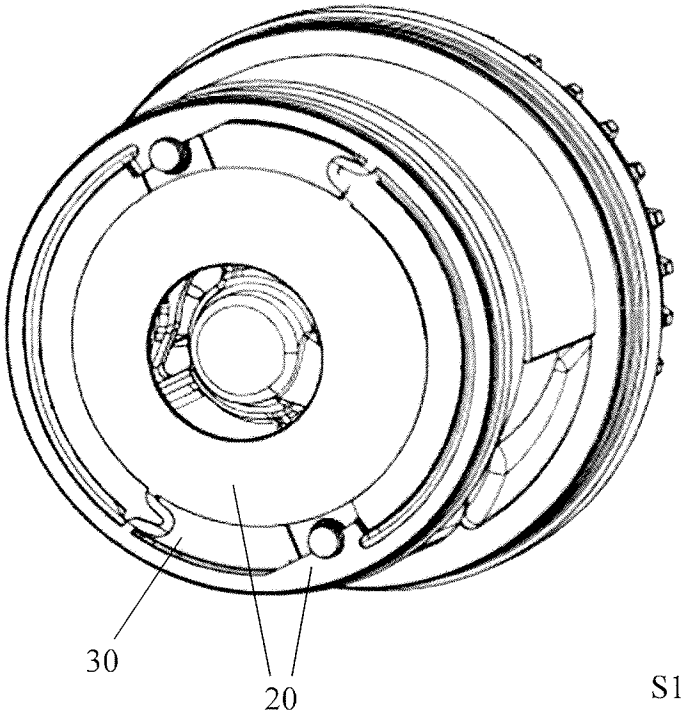
FIG. 18 the vane cell pump comprising a flow channelling device of a sixth example embodiment, in an isometric representation.
Figure 21:
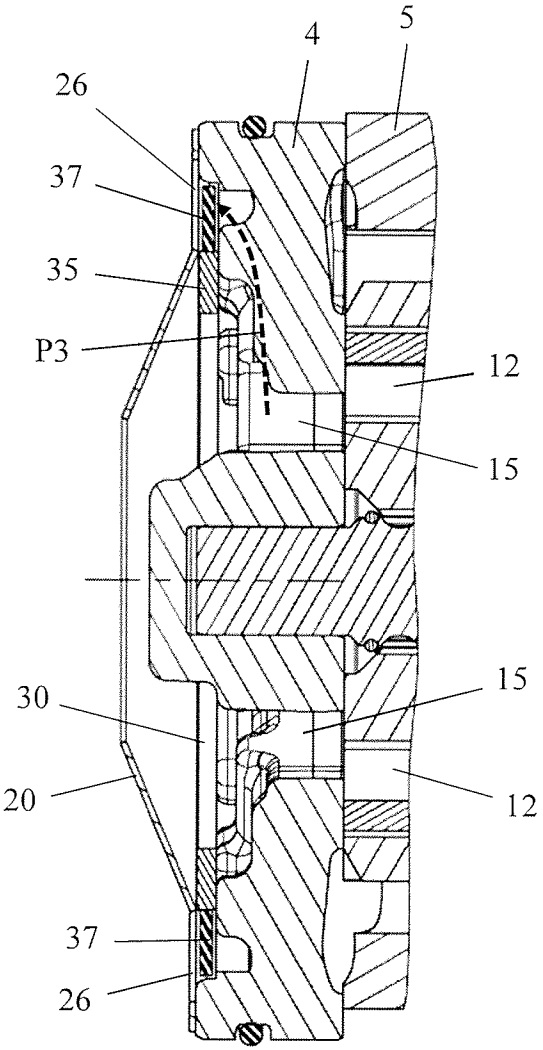
FIG. 21 the end plate and the flow channelling device of the sixth example embodiment, in another longitudinal section.
Figure 20:
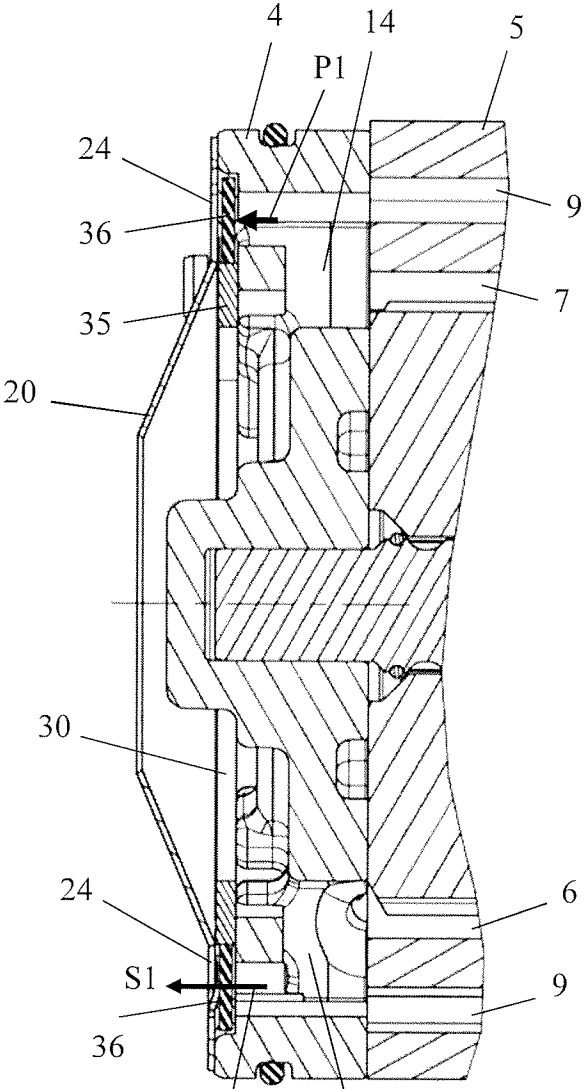
FIG. 20 the end plate and the flow channelling device of the sixth example embodiment, in a longitudinal section.
Figure 23:
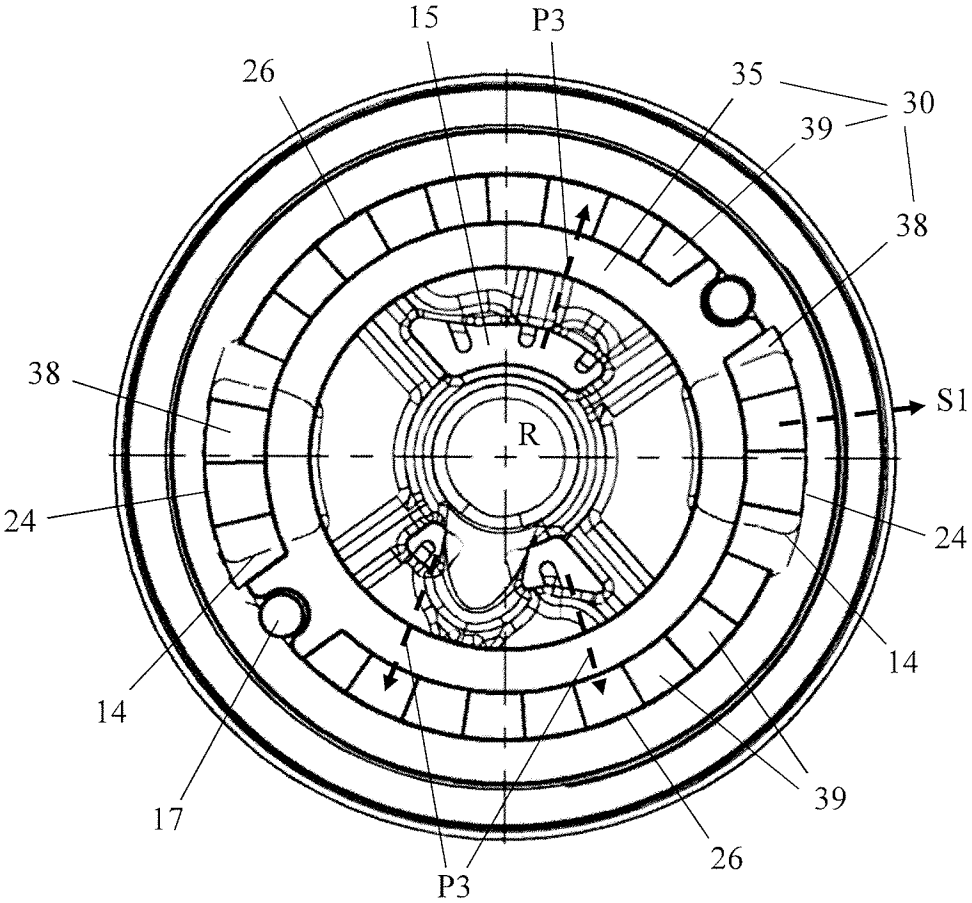
FIG. 23 the vane cell pump in an axial view onto a resistance structure of the flow channelling device of the seventh example embodiment.
Figure 22:
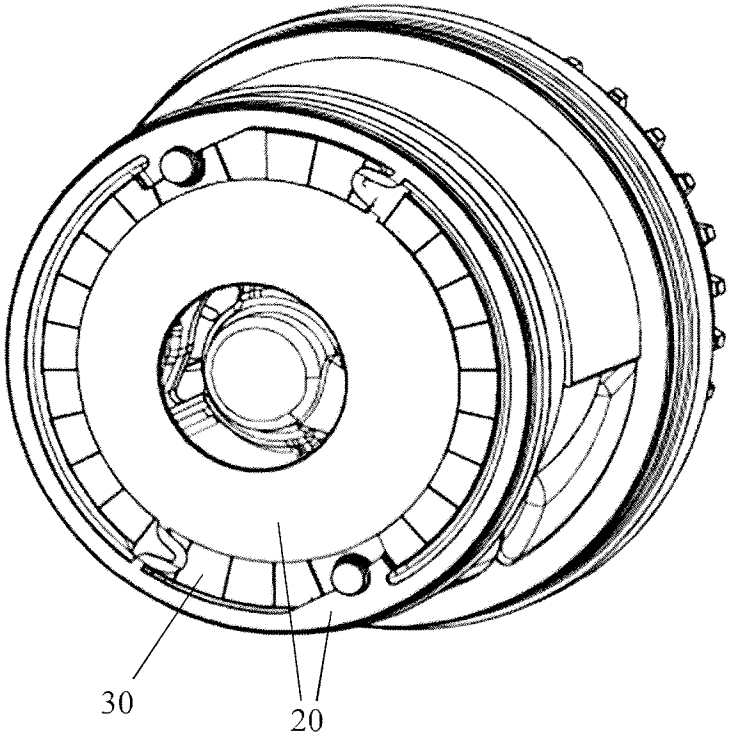
FIG. 22 the vane cell pump comprising a flow channelling device of a seventh example embodiment, in an isometric representation.
Figure 25:
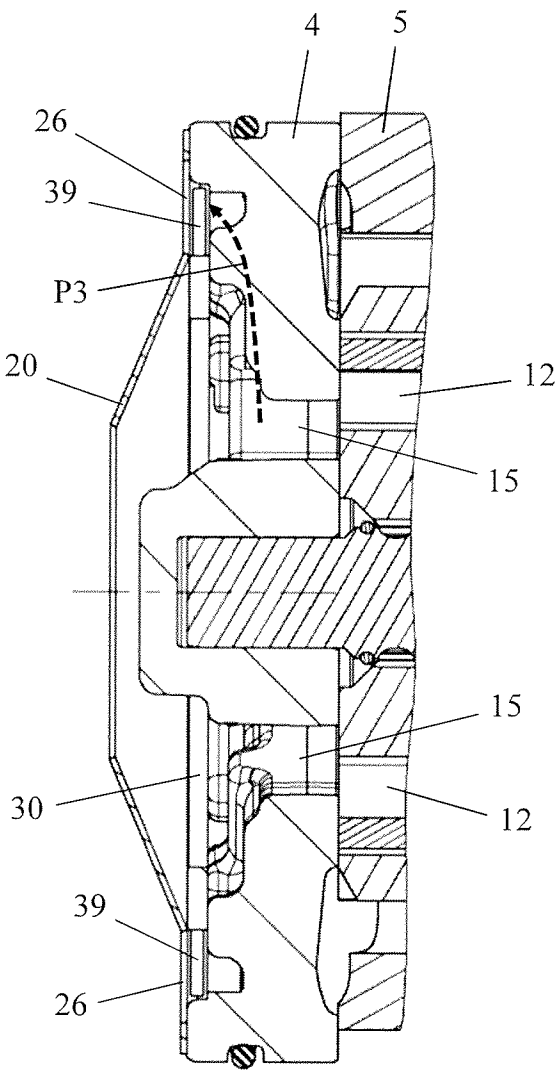
FIG. 25 the end plate and the flow channelling device of the seventh example embodiment, in another longitudinal section.
Figure 24:
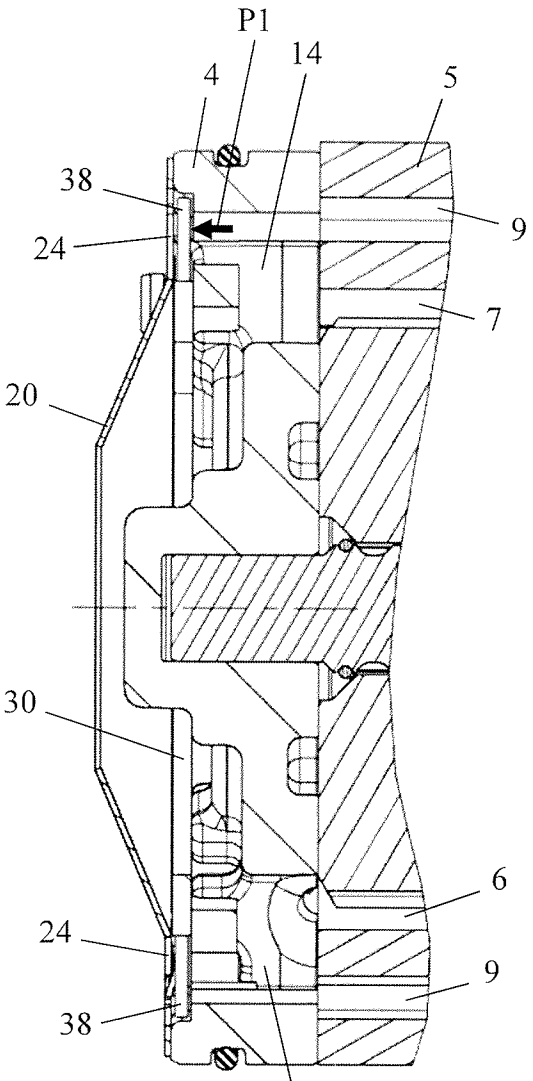
FIG. 24 the end plate and the flow channelling device of the seventh example embodiment, in a longitudinal section.

FIGS. 15 to 17 show a vane cell pump comprising a flow channelling device of a fifth example embodiment. Except for the flow channelling device, the vane cell pump corresponds to the pump described on the basis of FIGS. 1 to 5, such that reference is made to the statements in the foregoing, wherein the same reference signs are used for like components of the pump.

The flow channelling device of the fifth example embodiment comprises a flow channelling structure 20 which corresponds to the flow channelling structure 20 of the first example embodiment. The flow channelling device additionally comprises a resistance structure 30 and an abutment structure 40 (FIGS. 16 and 17) which in relation to the respective first outlet region 24 correspond to the resistance structure 30 and abutment structure 40 of the fourth example embodiment, i.e. they form a valve corresponding to the fourth example embodiment in axial overlap with the respective pressure passage 14. The resistance structure 30 and the abutment structure 40 are extended radially outwards in the circumferential region of the respective second outlet region 26, such that they form a resistance surface 32 immediately upstream of the respective second outlet region 26, as in the third example embodiment (FIGS. 9 to 11), wherein said resistance surface 32 extends the respective third flow path P3 and thus increases its flow resistance as a ratio of the flow resistance of the second flow path P2.

In modifications, it is possible to provide a valve as in the fourth or fifth example embodiment in the respective first flow path P1 and, instead of a resistance surface 32, a shutter comprising passages 31 as in the second example embodiment (FIGS. 6 to 8) in the respective third flow path P3, preferably immediately upstream of the respective second outlet region 26. It is also possible in modifications of the fourth and/or or fifth example embodiment to provide not just one moving valve element 33 but rather multiple moving valve elements of this type, next to each other in the circumferential direction, upstream of the respective first outlet region 24 in the first flow path P1. In yet other modifications, the resistance structure 30 and the abutment structure 40 can form a shutter comprising one or more passages 31 or instead a resistance surface 32 upstream of the respective first outlet region 24 in the first flow path P1, and one or more valves, each comprising a moving valve element 34, can be formed upstream of the respective second outlet region 26 in the respective third flow path P3. In other words, the different measures for increasing the resistance of the first flow path P1 and/or the third flow path P3 can also be implemented in combinations other than those illustrated with respect to the example embodiments.

The resistance structures 30 of the second, third, fourth and fifth example embodiments can in particular be produced by die-cutting. The passages 31 can be die-cut passages. The passages 31 are circular in the second and third example embodiments, but could instead also exhibit an oval shape in cross-section or could exhibit a slot-shaped or cruciform cross-section, wherein slot-shaped cross-sections can be straight or curved as viewed in an axial plan view. The passages 31 can be axially cylindrical. They can instead however also be widened or constricted in the flow direction and can for example be trumpet-shaped or bell-shaped or in particular conical. The passages 31 also need not be rotationally symmetrical. They can for example be shaped such that they imbue the pressure fluid with a directional component transverse to the axial direction as it flows through them, in order for example to channel the pressure fluid towards one of the supply passages 15 as it flows through the resistance structure.

The valve elements 33 and 34 of the fourth and fifth example embodiments can be produced by die-cutting a resistance blank, i.e. can be produced as die-cut valve elements. Die-cutting enables the valve elements 33 and 34 to be cropped in a simple way, each in the shape of a flexible spring tongue.

The valves of the fourth and fifth example embodiments are each other formed in the manner of a Reed valve by the abutment structure 40. In modifications, the abutment structure 40 can be shaped in conformity with the resistance structure 30 as a simple disc or ring which exhibits a small axial distance from the rear side of the resistance structure 30, such that the valve elements 33 and/or 34 formed as flexible spring tongues come into abutting contact against the modified abutment structure when they elastically yield, wherein this abutting contact need not be full-face or even planar, but can be linear or can occur only in a small planar region of the respective valve element 33 and/or 34.

FIGS. 18 to 21 show a vane cell pump comprising a flow channelling device of a sixth example embodiment. Except for the flow channelling device, the vane cell pump corresponds to the pumps described above, such that reference is made in particular to the statements made with respect to FIGS. 1 to 5, wherein the same reference signs are used for like components of the pump.

The flow channelling device of the sixth example embodiment comprises a flow channelling structure 20 which corresponds to the flow channelling structure 20 of the other example embodiments. The flow channelling device additionally comprises a resistance structure 30 respectively comprising an elastomeric valve 36 arranged in the first flow path P1 and respectively comprising an elastomeric valve 37 arranged in the third flow path P3. The resistance structure 30 also comprises a bearing structure 35, as can best be seen in FIG. 19, on which the elastomeric valve elements 36 and 37 can be elastically bent outwards in the axial direction, away from the end plate 4. The elastomeric valve elements 36 and 37 are formed as elastomeric spring tongues which protrude in the circumferential direction and are correspondingly curved about radial axes when they are bent away, due to the pressure of the pressure fluid which prevails in the flow channelling region. The elastomeric valve elements 36 and 37 act in principle in a comparable way to the valve elements 33 and 34. An abutment structure 40 is not however provided. The flow cross-section of the elastomeric valve formed by the respective elastomeric valve element 36 and 37 is thus determined only by the pressure force of the pressure fluid acting on the respective elastomeric valve element and by the elastic restoring force of the respective elastomeric element which is predetermined by the design.

FIGS. 22 to 25 show a vane cell pump comprising a flow channelling device of a seventh example embodiment. Except for the flow channelling device, the vane cell pump corresponds to the pump of the other example embodiments, such that reference is made to the above statements in this regard, wherein the same reference signs are used for like components of the pump.

The flow channelling device of the seventh example embodiment comprises a flow channelling structure 20 which corresponds to the flow channelling structure of the other example embodiments. The flow channelling device additionally comprises a resistance structure 30 which has been further developed on the basis of the resistance structure 30 of the sixth example embodiment (FIGS. 18 to 21). The resistance structure 30 of the seventh example embodiment comprises elastomeric valves which are arranged in a distribution about the rotational axis R and which comprise elastomeric valve elements 38 and 39. Unlike the sixth example embodiment, multiple elastomeric valves comprising elastomeric valve elements 38 and 39 are arranged both upstream of the first outlet region 24 of the respective flux in the first flow path P1 and upstream of the second outlet region 26 of the respective flux in the third flow path P3.

The resistance structure 30 of the seventh example embodiment comprises the same bearing structure 35 as the resistance structure of the sixth example embodiment. The elastomeric valve elements 38 and 39 which consist of an elastomer are moulded on the bearing structure 35, as in the sixth example embodiment, such that they can be elastically bent axially outwards from a root region and/or moulding region, away from the end plate 4. In the seventh example embodiment, an abutment structure is again not provided. The flow channelling device consists of the flow channelling structure 20 and the resistance structure 30, as in the sixth example embodiment.

The bearing structure 35 can be produced from a metallic material. It can however also be produced from a plastic. The elastomeric valve elements 36 and/or 37, as also the elastomeric valve elements 38 and/or 39, can be moulded on the bearing structure 35, as already mentioned, or joined to it in a material fit. In equally preferred embodiments, however, it is also possible for the bearing structure 35 and the elastomeric valve elements 36 and/or 37 of the sixth example embodiment and the elastomeric valve elements 38 and/or 39 of the seventh example embodiment to be jointly produced from an elastomeric material, including as applicable natural rubber, and for the respective elastomeric valve element to be produced by machine-finishing, in particular a separating process, performed on the resistance structure which is initially moulded in one piece. In the example embodiments, the elastomeric valve elements 36 to 39 are embodied as spring tongues which project from a root region in the circumferential direction. In alternative embodiments, the elastomeric valve elements 38 and/or 39 of the seventh example embodiment in particular, which are slim in the circumferential direction, can instead also project radially from the bearing structure 35 and can correspondingly be curved about a tangential axis and thus bent away from the end plate into the aperture position.

In alternative embodiments, the flow channelling structure 20 can provide an increased flow resistance in the first flow path P1 and/or in the third flow path P3 even in an integrated design, such that a resistance structure 30 which is produced separately from the flow channelling structure 20 can be omitted. The correspondingly modified flow channelling structure 20 can be formed in the first outlet region 24 of the respective flux and/or in the second outlet region 26 of the respective flux, for example as a shutter comprising multiple passages 31 which are smaller than the respective outlet region 24 and/or 26. In modifications of the fourth and/or fifth example embodiment (FIGS. 12 to 17), the flow channelling structure 20 can also form the abutments for the moving valve elements, such that a separately produced abutment structure can be omitted. It is in principle also conceivable to mould the elastomeric valve elements 36 and 37 of the sixth example embodiment and/or the elastomeric valve elements 38 and 39 of the seventh example embodiment on the flow channelling structure 20 in the first outlet region 24 and in the second outlet region 26 of the respective flux, such that the resistance structure 30 of these example embodiments can be omitted. If the resistance structure 30 is omitted, the increased resistance would be provided directly in the respective outlet region 24 and/or 26 rather than upstream of the respective outlet region 24 and/or 26 in the flow path P1 and/or P3. Producing them separately does however provide benefits in terms of cost and also in terms of ways of channelling the flow in the flow channelling region.

REFERENCE SIGNS

1 drive shaft
2 drive wheel
3 housing part
4 end plate
5 cam structure
6 delivery cell
7 delivery cell
8 overflow region
9 overflow channel
10 rotor
11 vane
23 sub-vane region
13 sub-vane region connection
14 pressure passage
15 supply passage
16 -
17 positioning element
18 -
19 securing region
20 flow channelling structure
21 channelling region
22 positioning region
23 connecting structure
24 first outlet region
25 deflecting region
26 second outlet region
27 positioning counter element
28 passant
29 -
30 resistance structure
31 passage
32 resistance surface
33 valve element
34 valve element
35 bearing structure
36 valve element
37 valve element
38 valve element
39 valve element
40 abutment structure
41 abutment
42 abutment
P1 first flow path
P2 second flow path
P3 third flow path
R rotational axis
S1 first partial flow
S2 second partial flow

The invention claimed is:

1. A vane cell pump, comprising:

a rotor which can be rotated about a rotational axis, and one or more vanes which can each be moved back and forth in a respective vane receptacle of the rotor;

a cam structure which surrounds the rotor and, when the rotor is rotationally moved, guides the vane(s) such that delivery cells which periodically increase and decrease in size are formed;

an end plate axially facing the rotor and comprising a pressure passage for discharging pressure fluid and a supply passage for supplying a sub-vane region with pressure fluid;

a flow channelling device on an end face of the end plate facing axially away from the rotor;

a first outlet region for discharging a first partial flow of the pressure fluid flowing through the pressure passage, wherein the first outlet region is formed as one or more passage openings of the flow channeling device;

a second outlet region for discharging a second partial flow of the pressure fluid flowing through the pressure passage;

a first flow path along which the first partial flow flows through the first outlet region;

a second flow path which connects the pressure passage to the supply passage, diverges from the first flow path and is delineated by the flow channelling device;

and a third flow path which connects the supply passage to the second outlet region and is delineated by the flow channelling device, wherein the first outlet region overlaps with a downstream outlet opening of the pressure passage as viewed axially.

2. The vane cell pump according to claim 1, wherein the first outlet region overlaps a first partial region of a downstream outlet opening of the pressure passage as viewed axially, and the flow channelling device overlaps a second partial region of the downstream outlet opening as viewed axially, such that a portion of the pressure fluid flowing out of the pressure passage flows off through the first outlet region as the first partial flow and another portion of the pressure fluid flowing out of the pressure passage is channelled to the side, into the second flow path, by the flow channelling device.

3. The vane cell pump according to claim 1, wherein the flow resistance of the third flow path and/or the flow resistance of the first flow path is greater than the flow resistance of the second flow path.

4. The vane cell pump according to claim 1, wherein a resistance structure is arranged in the third flow path and/or in the first flow path in order to increase the flow resistance of the third flow path and/or the flow resistance of the first flow path.

5. The vane cell pump according to claim 4, wherein the resistance structure forms a shutter comprising one or more mutually spaced passages, or a sieve, fabric or other mesh forms at least a partial region of the resistance structure which is situated in the first flow path and/or in the third flow path.

6. The vane cell pump according to claim 4, wherein the resistance structure comprises one or more moving valve elements which is/are arranged in the first flow path in order to vary a flow cross-section of the first flow path, and/or one or more moving valve elements which is/are arranged in the third flow path in order to vary a flow cross-section of the third flow path.

7. The vane cell pump according to claim 4, wherein the resistance structure is an axially thin, planar or sheet-like structure which comprises one or more passages in at least one or more structural partial regions and/or one or more flexible tongues which decrease(s) a flow cross-section in the first flow path and/or a flow cross-section in the third flow path and thus increase(s) the flow resistance of the respective flow path, wherein the respective passage and/or the respective flexible tongue is a die-cut passage or die-cut flexible tongue.

8. The vane cell pump according to claim 1, wherein the flow channelling device comprises a flow channelling structure for forming the first outlet region and/or the second outlet region and a resistance structure for increasing the flow resistance of a first flow path and/or the flow resistance of the third flow path, wherein the resistance structure is arranged axially between the end plate and the flow channelling structure.

9. The vane cell pump according to claim 8, wherein the resistance structure forms a shutter comprising one or more mutually spaced passages, or a sieve, fabric or other mesh forms at least a partial region of the resistance structure which is situated in the first flow path and/or in the third flow path.

10. The vane cell pump according to claim 1, wherein the flow channelling device comprises one or more valves in the first flow path in order to increase the flow resistance of the first flow path and/or one or more valves in the third flow path in order to increase the flow resistance of the third flow path.

11. The vane cell pump according to claim 1, wherein the flow channelling device comprises a flow channelling structure, and the flow channelling structure can be elastically deformed, in a dimensionally elastic way, in order to exert a tensing force on the end plate in the direction of the cam structure.

12. The vane cell pump according to claim 1, wherein the flow channelling device comprises a flow channelling structure, and a passage extending through the flow channelling structure forms the first outlet region and/or the second outlet region.

13. The vane cell pump according to claim 1, wherein the flow channelling device comprises a flow channelling structure, and the flow channelling structure comprises a passage which extends in the shape of an annular strip around the rotational axis, and the passage forms the first outlet region and the second outlet region, such that the outlet regions are arranged next to each other in the circumferential direction.

14. The vane cell pump according to claim 1, wherein the vane cell pump is embodied as a cartridge pump and inserted into a cup-shaped installation space of the pump, which is formed by an assembly which is to be supplied with the pressure fluid by the vane cell pump, or is provided for being inserted into a cup-shaped installation space of the pump.

15. The vane cell pump according to claim 1, wherein the vane cell pump is used for supplying lubricating fluid and/or working fluid to any one of the following: a transmission of a vehicle, a transmission of a wind turbine, or a mechanical transmission.

16. The vane cell pump according to claim 1, wherein the vane cell pump is used as a lubricating oil pump for supplying lubricating fluid to a drive motor of a vehicle or a combustion engine for generating power.

* * * * *